US009136652B2

(12) United States Patent
Ngo

(10) Patent No.: US 9,136,652 B2
(45) Date of Patent: Sep. 15, 2015

(54) ELECTRICAL CONNECTOR ASSEMBLY

(71) Applicant: Hung Viet Ngo, Austin, TX (US)

(72) Inventor: Hung Viet Ngo, Austin, TX (US)

(73) Assignee: FCI AMERICAS TECHNOLOGY LLC, Carson City, NV (US)

( * ) Notice: Subject to any disclaimer, the term of this patent is extended or adjusted under 35 U.S.C. 154(b) by 104 days.

(21) Appl. No.: 13/741,860

(22) Filed: Jan. 15, 2013

(65) Prior Publication Data

US 2013/0203296 A1 Aug. 8, 2013

Related U.S. Application Data

(60) Provisional application No. 61/595,834, filed on Feb. 7, 2012.

(51) Int. Cl.

| | |
|---|---|
| ***H01R 25/00*** | (2006.01) |
| ***H01R 24/00*** | (2011.01) |
| ***H01R 43/18*** | (2006.01) |
| ***H01R 12/72*** | (2011.01) |
| ***H01R 13/514*** | (2006.01) |
| ***H01R 24/20*** | (2011.01) |
| *H01R 13/627* | (2006.01) |

(52) U.S. Cl.

CPC ..... *H01R 24/00* (2013.01); *H01R 12/721* (2013.01); *H01R 13/514* (2013.01); *H01R 24/20* (2013.01); *H01R 43/18* (2013.01); *H01R 13/6273* (2013.01); *Y10T 29/49208* (2015.01); *Y10T 29/49222* (2015.01)

(58) Field of Classification Search

CPC .... H01R 31/06; H01R 31/065; H01R 23/025; H01R 27/02; H01R 2103/00

USPC ..... 439/638, 660, 634, 701, 717

See application file for complete search history.

(56) References Cited

U.S. PATENT DOCUMENTS

| | | | |
|---|---|---|---|
| 2,848,706 | A | 8/1958 | Besserer |
| 2,855,454 | A | 10/1958 | Alden |

(Continued)

FOREIGN PATENT DOCUMENTS

| | | |
|---|---|---|
| DE | 1903043 | 8/1969 |
| FR | 1268825 | 8/1961 |

(Continued)

OTHER PUBLICATIONS

U.S. Appl. No. 29/412,659, filed Feb. 6, 2012, Ngo.

(Continued)

*Primary Examiner* — Abdullah Riyami
*Assistant Examiner* — Vladimir Imas
(74) *Attorney, Agent, or Firm* — Baker & Hostetler LLP

(57) ABSTRACT

An electrical assembly can include one or more electrical connectors. Each electrical connector can include at least a first connector housing supporting a plurality of electrical power contacts and a second connector housing supporting a plurality of electrical signal contacts. Each of the first and second connector housings can define respective receptacles that are open on respective opposed sides of the first and second connector housings. Each electrical connector can further include at least one, such as a plurality of closure members configured to close the receptacles at respective lateral sides of the first and second connector housings. The closure members of the first and second electrical connectors can comprise at least one or all of end members, interconnect members, and spacer members.

31 Claims, 19 Drawing Sheets

(56) References Cited

U.S. PATENT DOCUMENTS

| | | | | |
|---|---|---|---|---|
| 3,048,811 | A | 8/1962 | Lock | |
| 3,212,047 | A | 10/1965 | McDonough | |
| 3,264,599 | A | 8/1966 | Kinkaid | |
| 3,333,231 | A | 7/1967 | Travis | |
| 3,467,944 | A | 9/1969 | Hammell et al. | |
| 3,524,161 | A | 8/1970 | Frantz et al. | |
| 3,551,878 | A | 12/1970 | Rossman | |
| 3,573,711 | A | 4/1971 | Henschen | |
| 3,685,001 | A | 8/1972 | Krafthefer | |
| 4,368,939 | A | 1/1983 | Foederer | |
| 4,790,763 | A | 12/1988 | Weber et al. | |
| 5,238,413 | A * | 8/1993 | McCaffrey et al. | 439/79 |
| 5,549,480 | A * | 8/1996 | Cheng | 439/79 |
| 5,575,690 | A | 11/1996 | Eaton | |
| D443,861 | S | 6/2001 | Ko et al. | |
| 6,322,377 | B2 | 11/2001 | Middlehurst et al. | |
| 6,368,120 | B1 * | 4/2002 | Scherer et al. | 439/101 |
| D488,815 | S | 4/2004 | Hashimoto et al. | |
| 6,780,027 | B2 * | 8/2004 | Allison | 439/79 |
| 6,790,053 | B2 * | 9/2004 | Lin et al. | 439/79 |
| 6,796,843 | B1 * | 9/2004 | Ryan et al. | 439/638 |
| 6,848,950 | B2 * | 2/2005 | Allison et al. | 439/682 |
| 6,884,106 | B2 | 4/2005 | Shuman et al. | |
| 6,896,556 | B1 * | 5/2005 | Wu | 439/638 |
| 6,945,816 | B1 * | 9/2005 | Wu | 439/545 |
| D517,488 | S | 3/2006 | Riku | |
| 7,037,142 | B2 * | 5/2006 | Evans | 439/680 |
| 7,059,919 | B2 * | 6/2006 | Clark et al. | 439/825 |
| 7,137,848 | B1 | 11/2006 | Trout et al. | |
| 7,140,925 | B2 * | 11/2006 | Allison et al. | 439/680 |
| D536,668 | S | 2/2007 | Ye et al. | |
| D542,736 | S | 5/2007 | Riku | |
| 7,278,883 | B2 | 10/2007 | Tyler | |
| 7,309,246 | B1 * | 12/2007 | Walter et al. | 439/181 |
| 7,488,222 | B2 * | 2/2009 | Clark et al. | 439/825 |
| 7,520,760 | B2 * | 4/2009 | Margulis et al. | 439/79 |
| 7,578,705 | B2 * | 8/2009 | He et al. | 439/660 |
| 7,651,350 | B1 * | 1/2010 | Wu | 439/153 |
| D610,548 | S | 2/2010 | Ngo | |
| D616,373 | S | 5/2010 | Hemmi et al. | |
| 7,762,857 | B2 * | 7/2010 | Ngo et al. | 439/856 |
| 7,794,273 | B2 * | 9/2010 | Xu et al. | 439/555 |
| D631,442 | S | 1/2011 | Ngo | |
| 7,867,045 | B2 * | 1/2011 | McAlonis | 439/891 |
| 7,892,045 | B2 | 2/2011 | Ratzlaff et al. | |
| D641,321 | S | 7/2011 | Ngo | |
| 7,980,860 | B2 * | 7/2011 | Yu et al. | 439/65 |
| 8,007,320 | B1 * | 8/2011 | Zhang et al. | 439/638 |
| 8,052,479 | B1 * | 11/2011 | Zhu | 439/660 |
| 8,057,266 | B1 * | 11/2011 | Roitberg | 439/682 |
| 8,096,814 | B2 * | 1/2012 | Schell et al. | 439/79 |
| 8,109,796 | B2 * | 2/2012 | Chen | 439/660 |
| D664,096 | S | 7/2012 | Ngo | |
| 8,282,402 | B2 * | 10/2012 | Ngo | 439/79 |
| 8,323,049 | B2 * | 12/2012 | Ngo | 439/552 |
| 8,419,477 | B1 * | 4/2013 | Yu et al. | 439/626 |
| 8,435,047 | B2 | 5/2013 | Patel et al. | |
| 8,535,103 | B2 * | 9/2013 | Lim et al. | 439/741 |
| 8,574,015 | B2 * | 11/2013 | Tai et al. | 439/682 |
| 8,702,445 | B2 * | 4/2014 | Yu et al. | 439/485 |
| 8,727,796 | B2 * | 5/2014 | Ngo | 439/79 |
| 2003/0224654 | A1 * | 12/2003 | Wu | 439/573 |
| 2005/0227548 | A1 | 10/2005 | Sian | |
| 2008/0064264 | A1 * | 3/2008 | Clark et al. | 439/626 |
| 2008/0305682 | A1 * | 12/2008 | Wu | 439/604 |
| 2009/0088028 | A1 * | 4/2009 | Ngo et al. | 439/682 |
| 2010/0184339 | A1 | 7/2010 | Ngo et al. | |
| 2010/0197166 | A1 * | 8/2010 | Ngo | 439/552 |
| 2011/0151701 | A1 * | 6/2011 | Ngo | 439/327 |
| 2011/0300760 | A1 * | 12/2011 | Ngo | 439/636 |
| 2012/0289071 | A1 * | 11/2012 | Dodds et al. | 439/183 |
| 2013/0040483 | A1 * | 2/2013 | Ngo et al. | 439/328 |
| 2013/0040500 | A1 * | 2/2013 | Ngo | 439/660 |

FOREIGN PATENT DOCUMENTS

| | | |
|---|---|---|
| FR | 1498649 | 10/1967 |
| FR | 2008820 | 1/1970 |
| GB | 1187949 | 4/1970 |
| GB | 1237652 | 6/1971 |

OTHER PUBLICATIONS

U.S. Appl. No. 29/412,794, filed Feb. 7, 2012, Ngo.
U.S. Appl. No. 29/412,796, filed Feb. 7, 2012, Ngo.

* cited by examiner

ELECTRICAL CONNECTOR ASSEMBLY

CROSS-REFERENCE TO RELATED APPLICATIONS

This application claims the benefit of U.S. Provisional Application No. 61/595,834 filed Feb. 7, 2012, the contents of which are hereby incorporated by reference herein in its entirety.

BACKGROUND

Electronics devices, such as digital communications devices, continue to evolve at a fast pace. As this evolution continues, it is desirable for such devices to transfer increasing amounts of data at higher speeds, which may cause the power requirements of those devices to change. As data rates and power requirements change, new electrical connectors may be required to interconnect the evolving devices. However, designing and fabricating updated electrical connectors can be expensive and time consuming. For instance, the production of a new electrical connector typically requires tooling changes, production facility reconfiguration, and the significant time and capital expenses associated therewith.

SUMMARY

In accordance with an embodiment, an electrical connector comprises a first connector housing supporting a plurality of electrical power contacts. The first connector housing has a first housing body that defines a front end, a rear end spaced from the front end along an mating direction, and opposed first and second sides extending between the front and rear ends and spaced apart from each other along a second direction that extends substantially perpendicular to the mating direction. The first housing body further defines a receptacle at the front end that is elongate along the second direction so as to define a power mating interface, wherein the receptacle extends through the first and second sides. The electrical connector can further include a second connector housing supporting a plurality of electrical signal contacts. The second connector housing has a second housing body that defines a front end, a rear end spaced from the front end along the mating direction, and opposed first and second sides extending between the front and rear ends of the second connector housing and spaced apart from each other along the second direction. The first side of the second connector is disposed adjacent the second side of the first connector housing. The second housing body further defines a receptacle at the front end that extends along the second direction so as to define a signal mating interface, wherein the receptacle of the second connector housing extends through the first and second sides of the second connector housing. The electrical connector can further include a first end member that is separate from the first connector housing and is configured to be coupled to the first side of the first connector housing so as to close one end of the receptacle of the first connector housing. The electrical connector can further include a second end member that is separate from the second connector housing and is configured to be coupled to the second side of the second connector housing so as to close one end of the receptacle of the second connector housing.

In accordance with another embodiment, a method includes the steps of coupling a first end member to a first side of a first connector housing. The first connector housing supports a plurality of electrical power contacts and defines a receptacle that is elongate along a mating end of the first connector housing from the first side to an opposed second side that is spaced from the first side, wherein the receptacle defines a mating interface and extends through the first and second sides. The method further includes the step of coupling a second end member to a second side of a second connector housing. The second connector housing supports a plurality of electrical signal contacts and defining a receptacle that is elongate along a mating end of the second connector housing from the first side of the second connector housing to an opposed second side of the second connector housing that is spaced from the first side of the second connector housing, wherein the receptacle defines a mating interface and extends through the first and second sides. The method further includes the step of closing the receptacle at the first side of the first connector housing by coupling the first end member to the first side of the first connector housing.

In accordance with another embodiment, a kit can include at least one first connector housing supporting a plurality of electrical power contacts. The first connector housing has a first housing body that defines a front end, a rear end spaced from the front end along an mating direction, and opposed first and second sides that extend between the front and rear ends and are spaced apart from each other along a second direction that extends substantially perpendicular to the mating direction. The first housing body further defines a receptacle at the front end that is elongate along the second direction so as to define a power mating interface, wherein the receptacle extends through the first and second sides. The kit further includes at least one second connector housing supporting a plurality of electrical signal contacts. The second connector housing has a second housing body that defines a front end, a rear end spaced from the front end along the mating direction, and opposed first and second sides that extend between the front and rear ends of the second connector housing and are spaced apart from each other along the second direction. The second housing body further defines a receptacle at the front end that extends along the second direction so as to define a signal mating interface, wherein the receptacle extends through the first and second sides of the second connector housing. The kit further includes a plurality of closure members configured to be coupled to at least one of the first and second to respective sides of at least one of the first and second connector housings so as to close at least one end of the corresponding receptacle.

In accordance with another embodiment, a method of assembling an electrical assembly includes the step of providing or teaching the use of a first connector housing supporting a plurality of electrical power contacts and defining a first receptacle that extends along a front end of the first connector housing and through opposed first and second sides of the first connector housing, a second connector housing supporting a plurality of electrical signal contacts and defining a second receptacle that extends along a front end of the second connector housing and through opposed first and second sides of the second connector housing, and first and second end members configured to close respective ones of the first and second receptacles. The method can further include teaching the step of mounting the first end member to the first side of the first connector housing. The method can further include teaching the step of mounting the second end member to the second side of the second connector housing.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
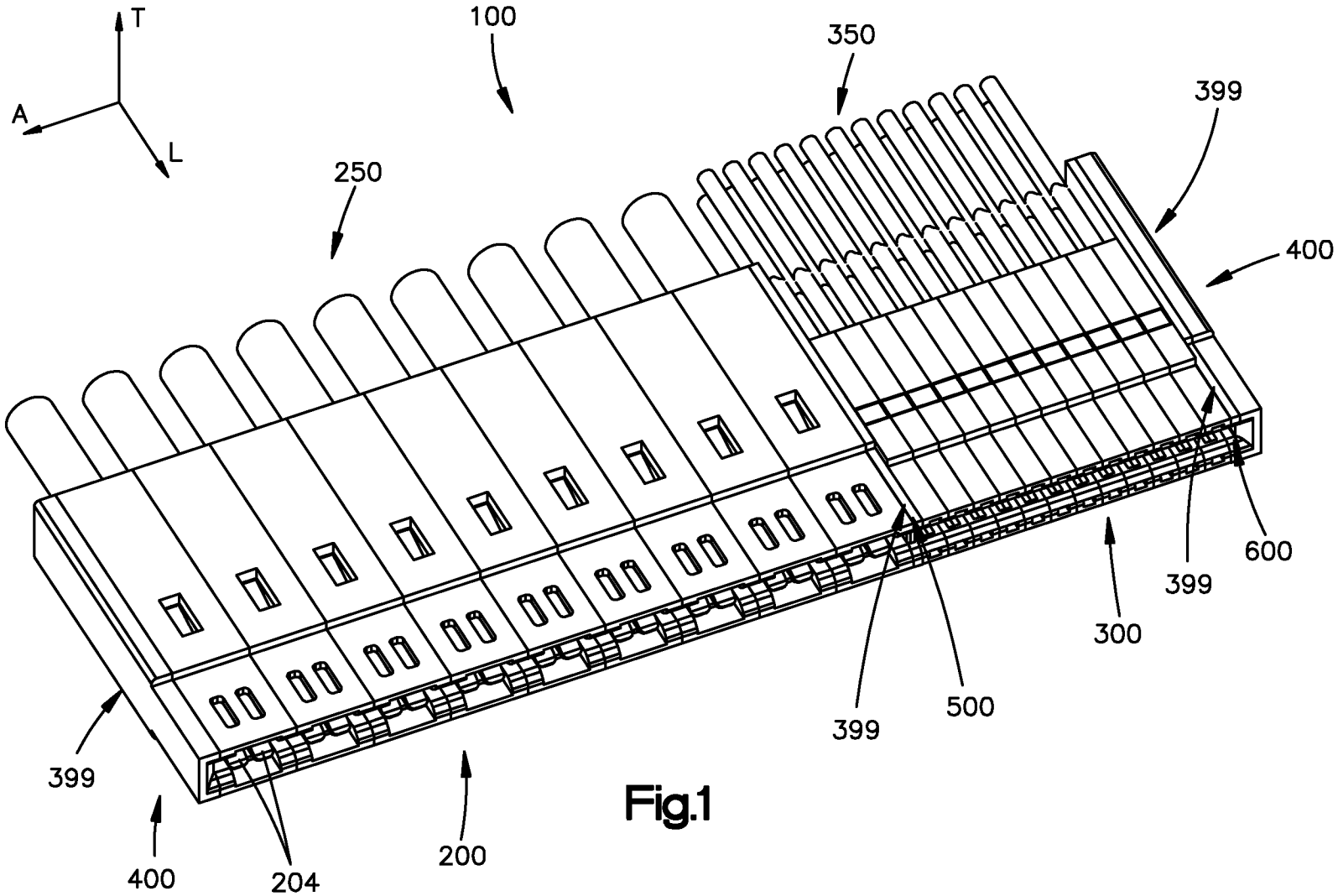
FIG. 1 is a perspective view of an electrical assembly including a power connector housing, a signal connector housing, and a plurality of closure members.

For convenience, the same or equivalent elements in the various embodiments illustrated in the drawings have been identified with the same reference numerals. Certain terminology is used in the following description for convenience only and is not limiting. The words "left", "right", "front", "rear", "upper," and "lower" designate directions in the drawings to which reference is made. The words "forward", "forwardly", "rearward", "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 10A:
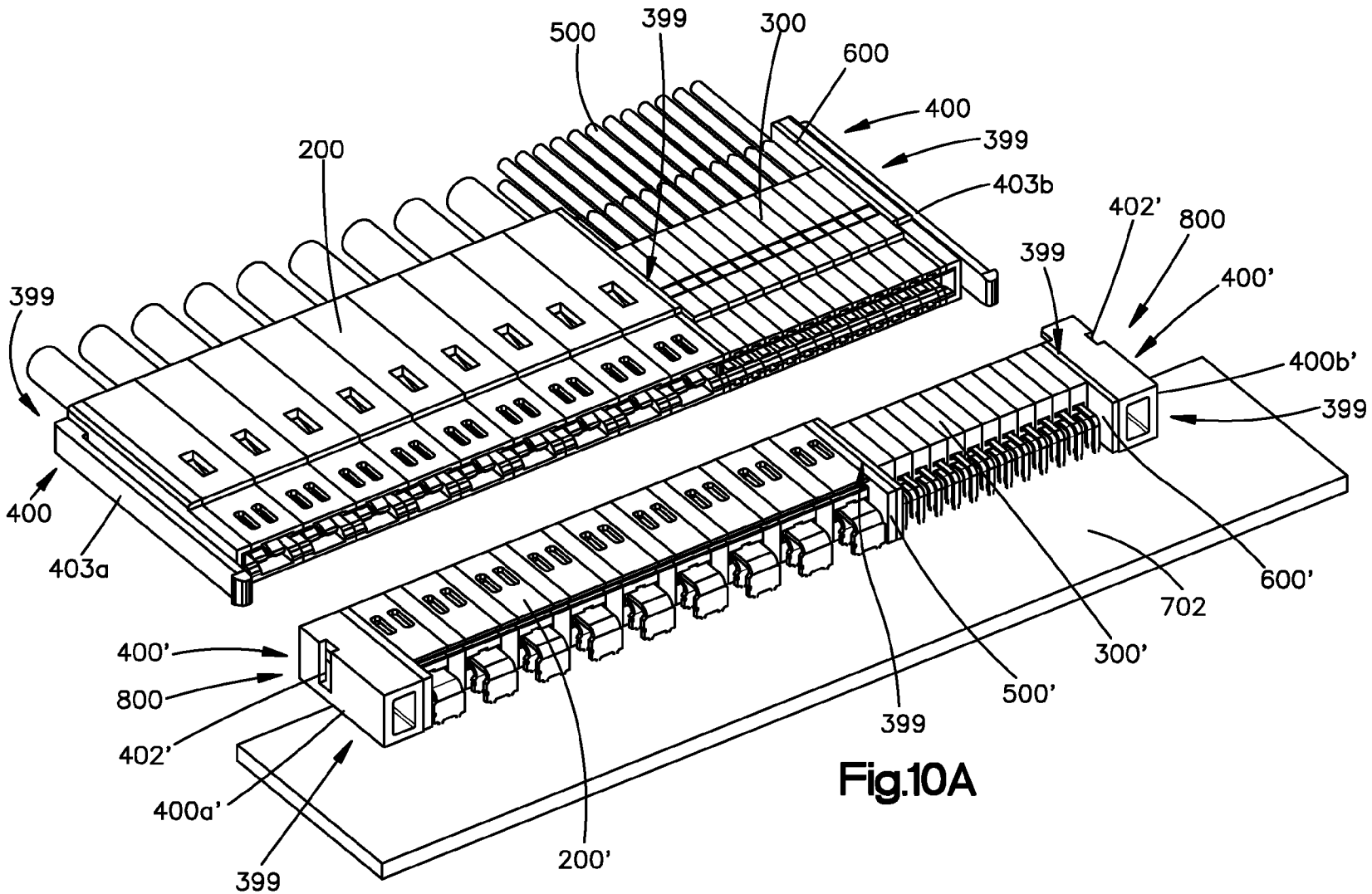
FIG. 10A is a perspective view of a first electrical assembly constructed in accordance with the an alternative embodiment utilizing the closure members illustrated in FIGS. 9A-B and a second electrical assembly configured as a header connector mounted to a substrate.

Referring initially to FIGS. 1 and 10A, an electrical connector assembly can includes a first electrical connector 100 and a second electrical connector 800 configured to be mated with the first electrical connector 100. The electrical connector assembly can further include one or more complementary electrical devices configured to be electrically connected to the first and second electrical connectors. For instance, the electrical connector assembly can include at least one such as a plurality of power cables 250 configured to be electrically connected to the first electrical connector 100, and at least one such as a plurality of signal cables 350 configured to be electrically connected to the first electrical connector 100. The electrical connector assembly can further include one or more substrates 700 that can be configured as printed circuit boards 702. For instance, the first connector 100 can be mated to a substrate 700 (see FIG. 6), and the second connector 800 can be mounted to a substrate 700 (see FIGS. 10A-B). Thus, it should be appreciated that each of the first and second electrical connectors 100 and 800 are configured to be mated to a complementary electrical device, and are further configured to be mounted to a complementary electrical device. In accordance with the illustrated embodiment, the first electrical connector 100 is a receptacle connector and the second electrical connector 800 is configured as a header connector that is received by the first electrical connector 100 when the first and second electrical connectors are mated, thought it should be appreciated that the first electrical connector 100 can alternatively be configured as a header connector and the second electrical connector 800 can alternatively be configured as a receptacle connector as desired.

Figure 13:
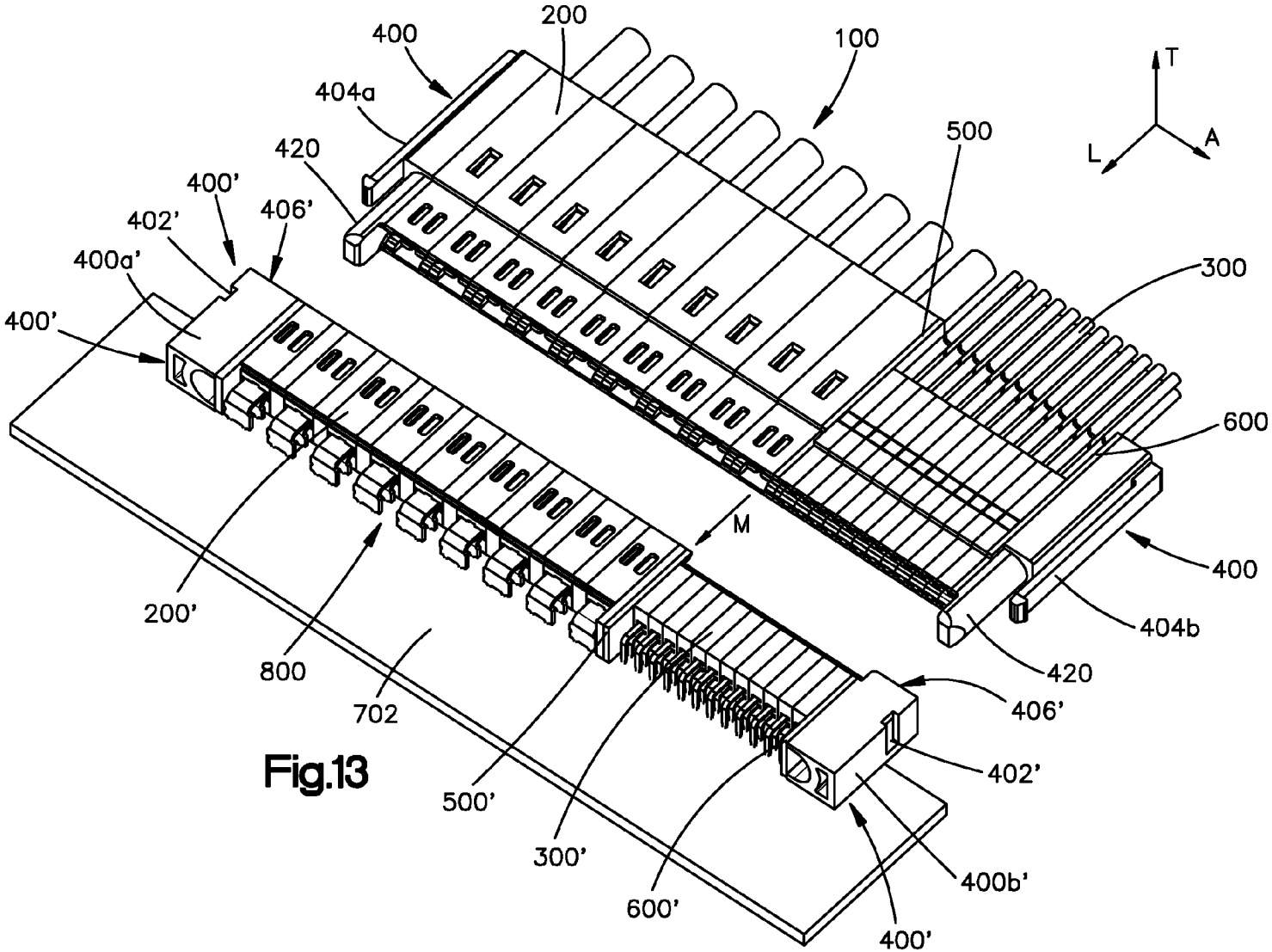
FIG. 13 is a perspective view of a first electrical assembly constructed in accordance with an alternative embodiment utilizing an alternative embodiment of the closure members illustrated in FIGS. 11A-B.
Figure 14A:
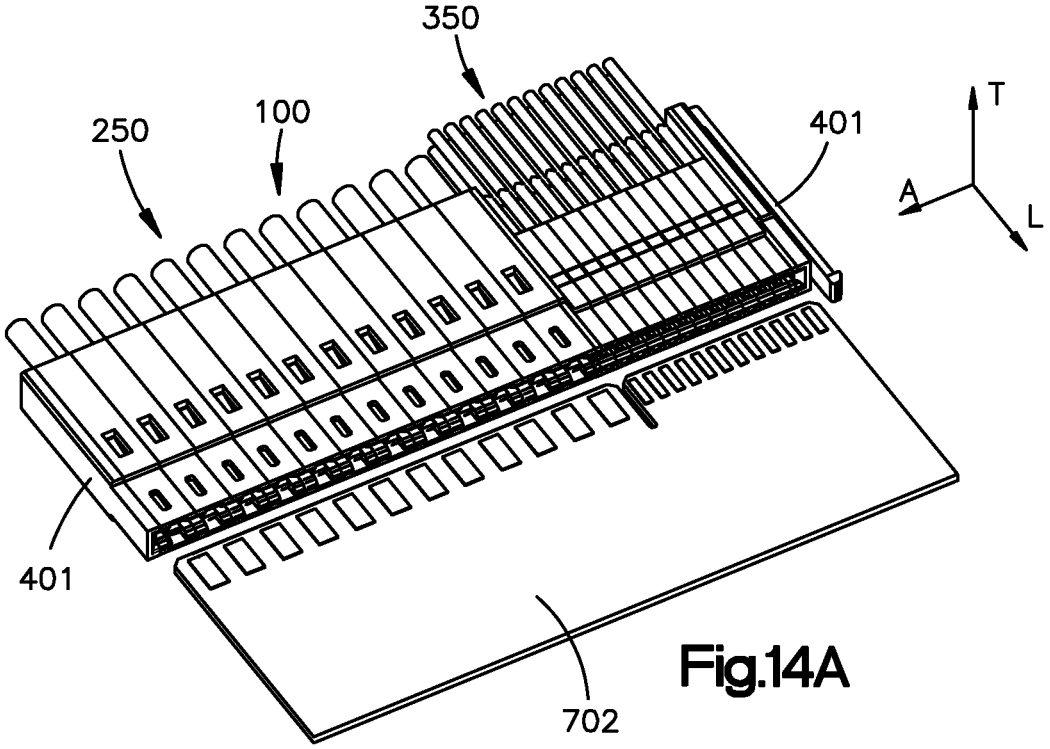
FIG. 14A is a perspective view of an alternative embodiment of the electrical assembly illustrated in FIG. 6, constructed utilizing an alternative embodiment of the power connector housing.
Figure 14B:
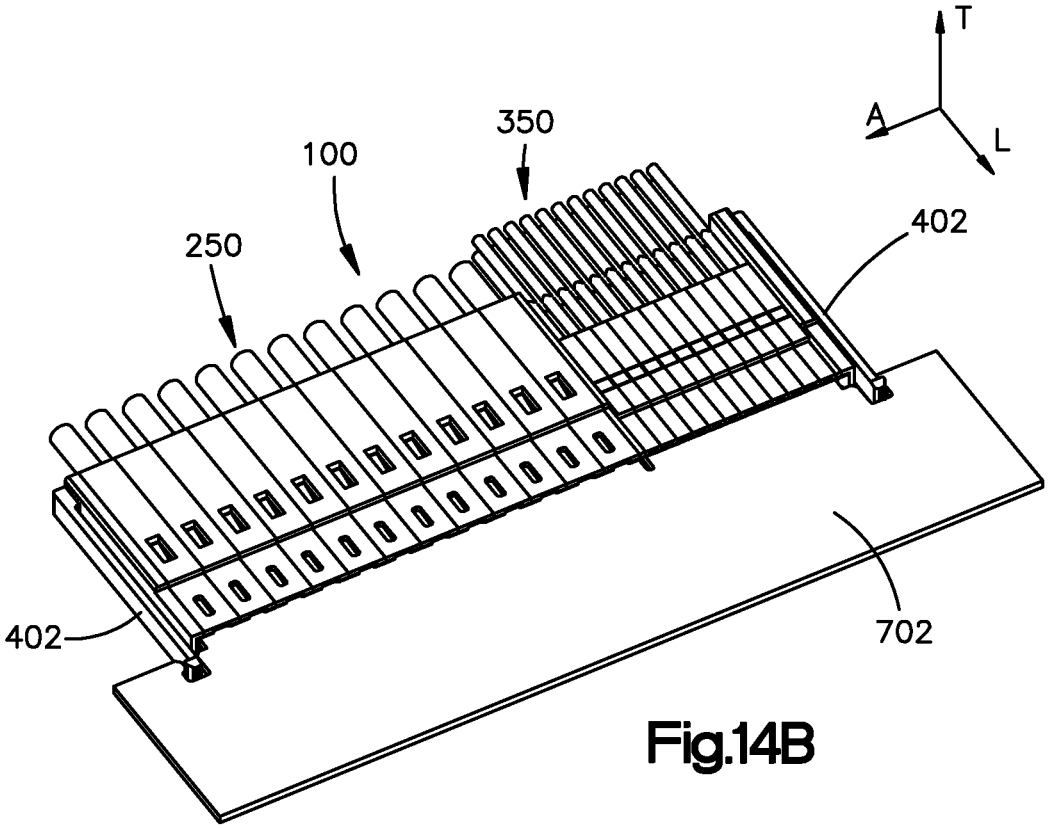
FIG. 14B is a perspective view of an alternative embodiment of the electrical assembly illustrated in FIG. 8, constructed utilizing an alternative embodiment of the power connector housing.
Figure 14C:
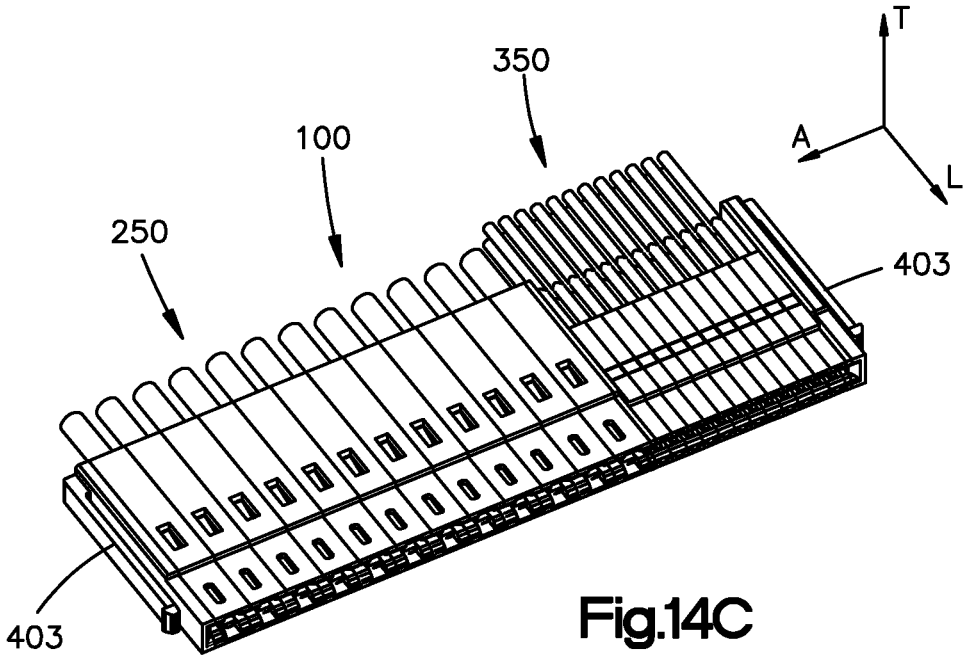
FIG. 14C is a perspective view of an alternative embodiment of the first electrical assembly illustrated in FIG. 10A, constructed utilizing an alternative embodiment of the power connector housing.
Figure 14D:
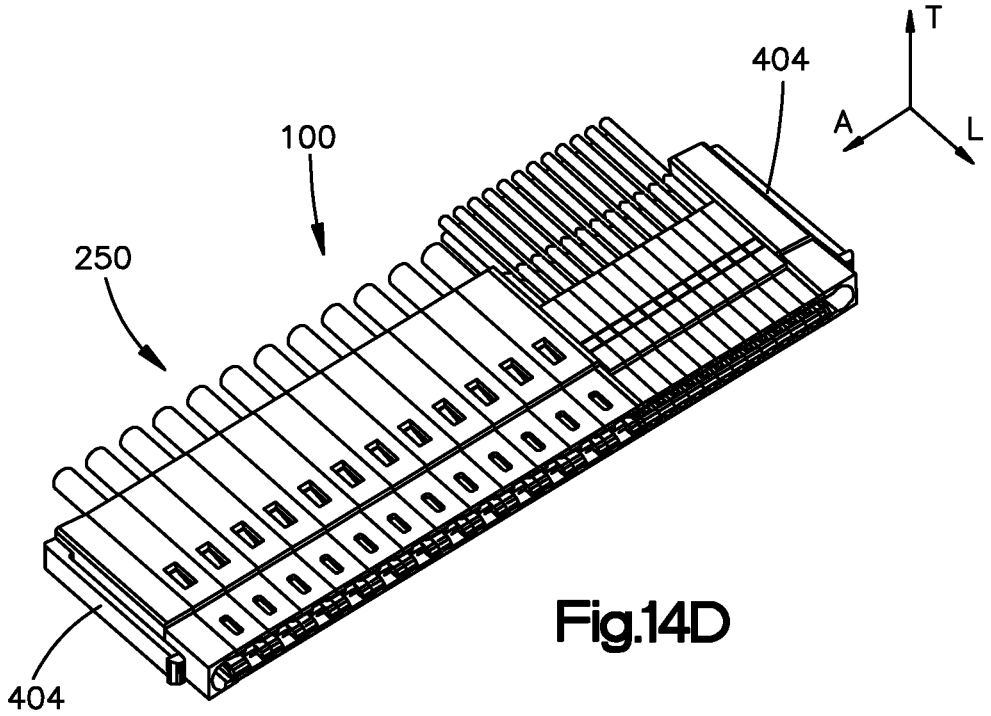
FIG. 14D is a perspective view of an alternative embodiment of the first electrical assembly illustrated in FIG. 12A, constructed utilizing an alternative embodiment of the power connector housing.

Referring now to FIG. 1, the first electrical connector 100 can include at least one or both of a first connector housing 200 that can be a power connector housing, and a second connector housing 300 that can be a signal connector housing. The first connector housing 200 and the second connector housing 300 can be integrally molded together. The first electrical connector 100 can further include at least one such as a plurality of first electrical contacts such as electrical power contacts 204 configured to be supported by the first connector housing 200, and further include at least one such as a plurality of second electrical contacts such as electrical signal contacts 304 configured to be supported by the second connector housing 300. The first connector housing 200 is configured to receive power cables 250 that are configured to be coupled to the electrical power contacts 204 so as to place the power cables 250 in electrical communication with the electrical power contacts 204. The second connector housing 300 is configured to receive the signal cables 350 that are configured to be coupled to the electrical signal contacts 304 so as to place the signal cables 350 in electrical communication with the electrical signal contacts 304. As shown in FIG. 13, the second connector housing 300 can include a plurality of holes that are defined by the second connector housing 300 and are positioned over the electrical signal contacts 304. One first plurality of holes can be heat holes, and a second plurality of holes can be electrical signal contact 304 retention holes.

Figure 2A:
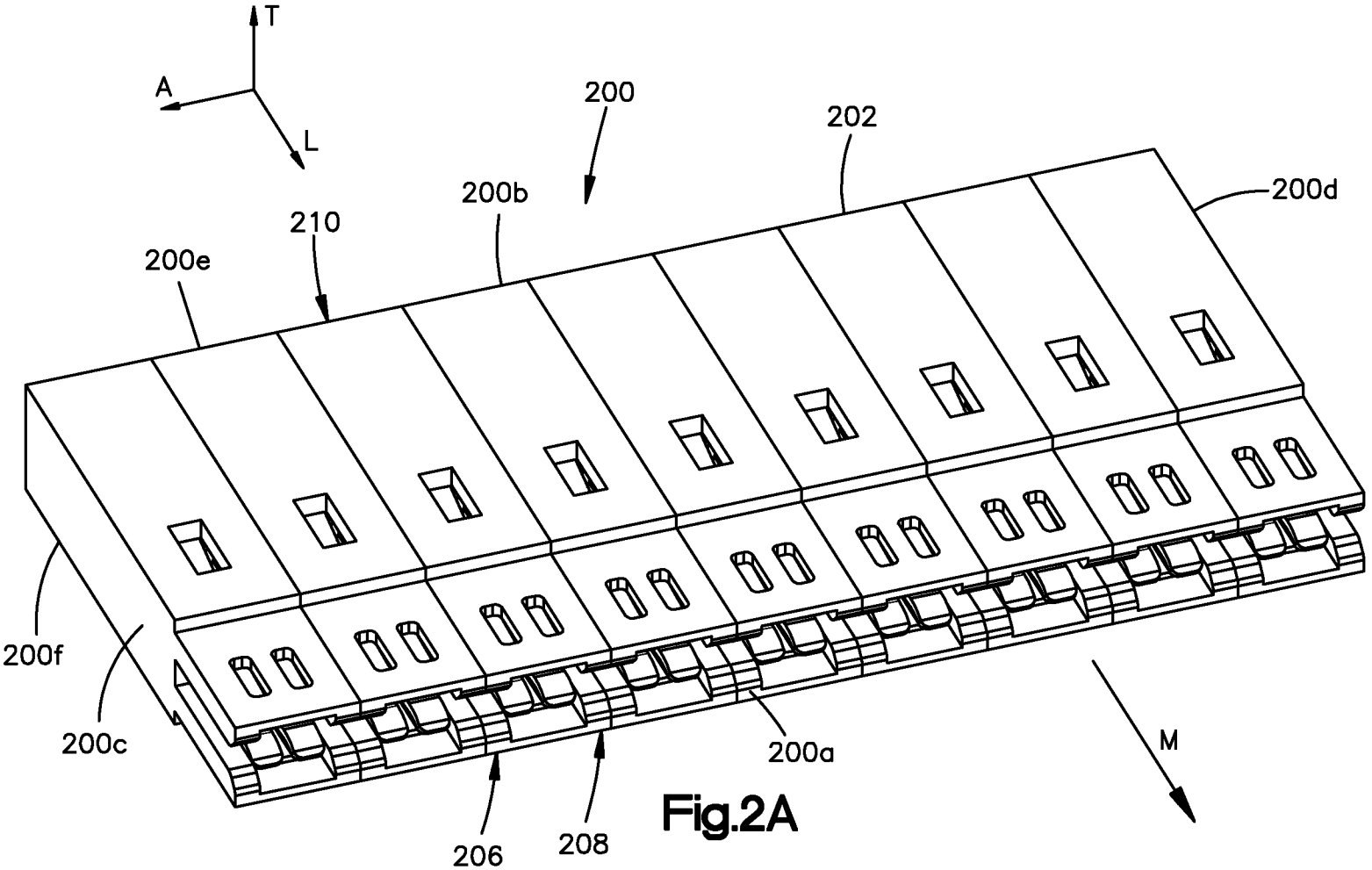
FIGS. 2A-C are perspective views of the power connector housing illustrated in FIG. 1 and a pair of power contact inserts configured to be disposed in the power connector housing.
Figure 2B:
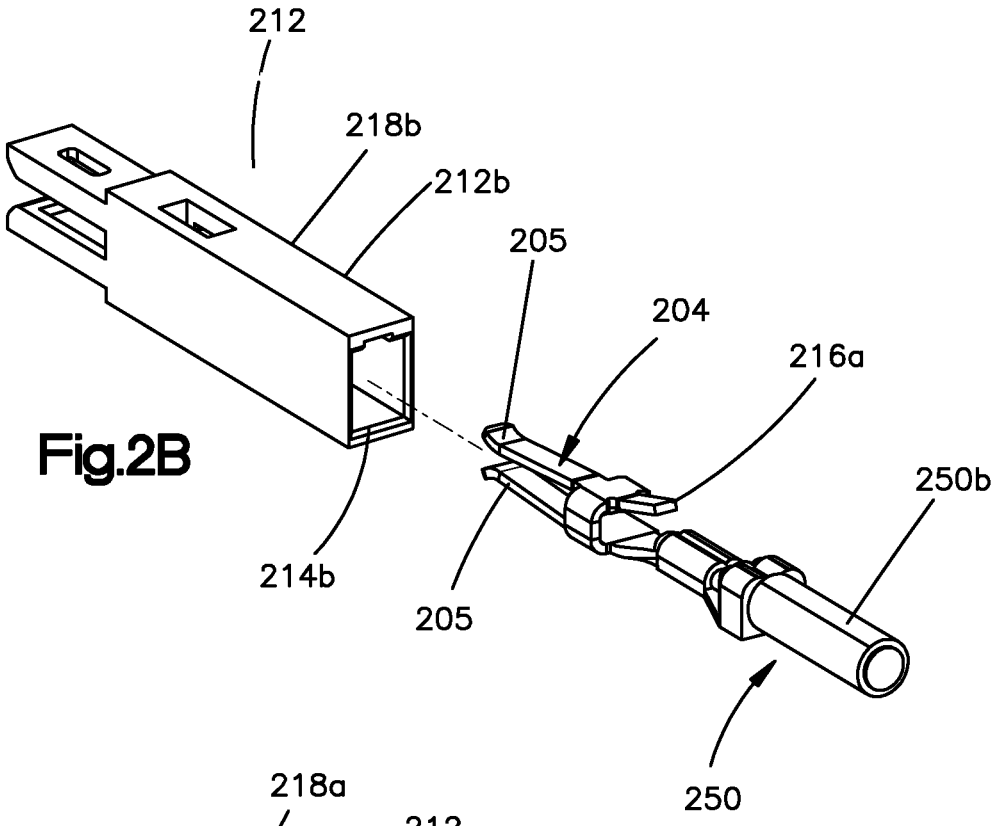
Figure 2C:
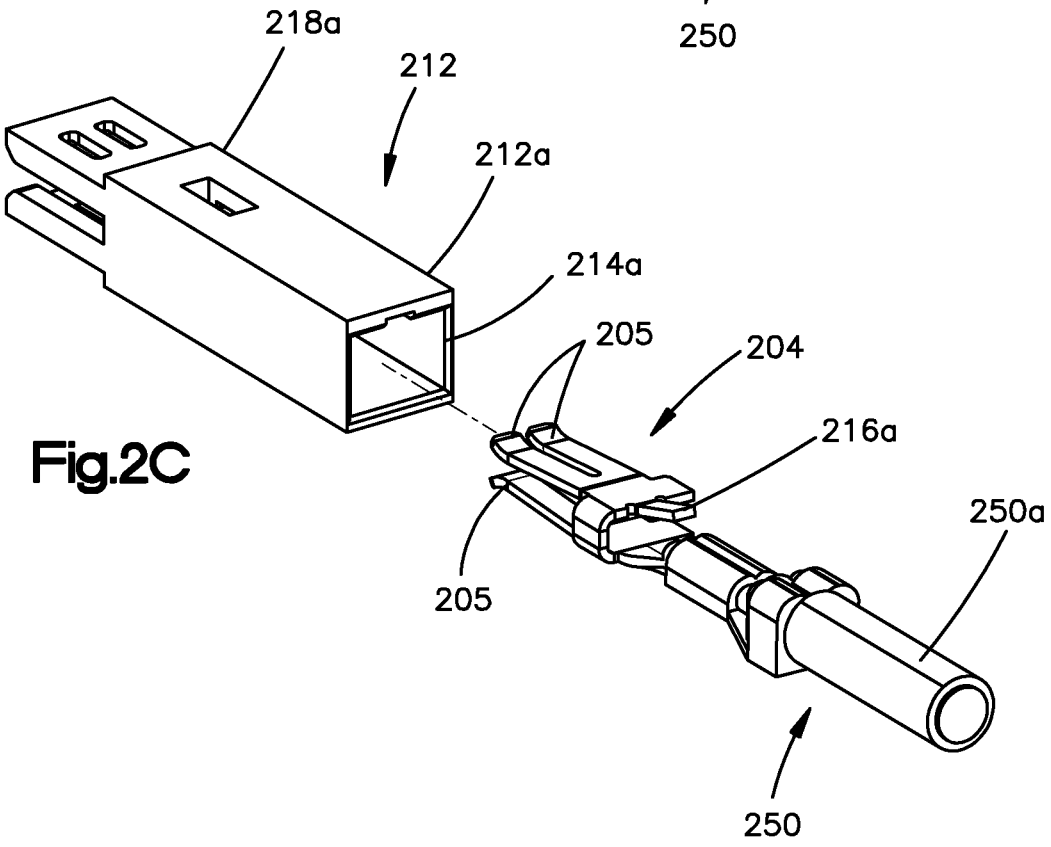

Referring now to FIGS. 2A-C, the first connector housing 200 includes a housing body 202 that defines a front end 200*a*, an opposed rear end 200*b* that is spaced from the front end 200*a* along a first or longitudinal mating direction L, opposed first and second sides 200*c* and 200*d* that extend between the front and rear ends 200*a-b* and are spaced apart from each other along a second lateral direction A that extends substantially perpendicular to the longitudinal direction L, an upper end 200*e*, and an opposed lower end 200*f* that is spaced from the upper end 200*e* along a third or transverse direction T that extends substantially perpendicular to both the longitudinal direction L and the lateral direction A. The housing body 202 is illustrated in FIG. 2A in an orientation such that the transverse direction T is vertical and the longitudinal and lateral directions L and A are horizontal, though it should be appreciated that the orientation of the housing body 202, and of the first electrical connector 100, can differ during use.

The first connector housing 200 can define a receptacle 206 that extends into the front end 200*a* of the housing body 202 along the longitudinal direction L, and can be elongate along the lateral direction A. For instance, the receptacle 206 can extend through one or both of the first and second sides 200*c* and 200*d*. The front end 200*a* of the housing body 202 can define a power mating interface 208, such that the receptacle 206 can be disposed at the power mating interface 208. The first connector housing 200, and thus the first electrical connector 100, is configured to mate with a complementary electrical device at the power mating interface 208. For example, in accordance with the illustrated embodiment, the power mating interface 208 can be configured to receive at least a portion of a substrate 700, such as a printed circuit board 702, that is inserted into the receptacle 206. Therefore, the receptacle 206 can be said to extend into the first connector housing 200 along a mating direction M that can be, for instance, the longitudinal direction L. As described above, the receptacle 206 can be open at the first and second sides 200*c* and 200*d* of the first connector housing 200. Therefore, it can also be said that the receptacle 206 extends into the front end 200*a* along a second direction that can be, for instance, the lateral direction A, such that the power mating interface 208 is open at the first and second sides 200*c* and 200*d* of the first connector housing 200.

The first electrical connector 100 can further include at least one such as a plurality of closure members 399. The closure members 399, which can be made from metal, plastic, nylon, etc., can include at least one such as a plurality of end members 400 and at least one such as a plurality of interconnect members 500. The end members 400 are configured to be coupled, releasably attached, or integrally molded to the first connector housing 100, for instance at one or both of the first and second sides 200*c* and 200*d* so as to close the corresponding first open lateral end of the receptacle 206. As will be appreciated from the description below, the end members 400 are configured to be coupled to the second connector housing 300 so as to close one or both open ends of a respective receptacle 306 defined by the second connector housing 300. The interconnect member 500, which can be a PCB keying guide or keying wall, can be configured to be coupled to one or both of the first connector housing 200 and the second connector housing 300. For instance the interconnect member 500 can be configured to close the corresponding second open lateral end of the receptacle 206 that is opposite the first open lateral end of the receptacle 206. Furthermore, the interconnect member 500 can be configured to close an open lateral end of the receptacle 306 of the second connector housing 300 that is opposite to the open lateral end of the receptacle 306 that is closed by the respective end member 400.

The first electrical connector 100 can further include at least one spacer member 600 that can be disposed between one of the closure members, for instance end members 400, and a respective one of the first and second connector housings 200 and 300. In this regard, the end members 400 can be coupled directly to the connector housings 200 and 300, for instance affixed to the connector housings 200 and 300, or can be coupled indirectly to the connector housings 200 and 300, for instance affixed to a spacer member 600 which can in turn affixed to the respective first and second connector housings 200 or 300.

Referring also to FIGS. 2A-C, the electrical power contacts 204 can define respective mating ends 205 configured to be mated to the electrical device that is mated to the first connector housing 200, and respective mounting ends that are configured to be placed in electrical connection with respective ones of the power cables 250. The electrical power contacts 204 can be supported by the housing body 202 such that the respective mating ends 205 are disposed in the receptacle 206 at the power mating interface 208. The first connector housing 200 can further define at least one cavity 210 that extends into the rear end 200*b* of the housing body 202. The cavity 210 can be defined by an upper wall disposed at the upper end 200*e*, a lower wall disposed at the lower end 200*f*, and opposed side walls disposed at the first and second sides 200*c* and 200*d* of the first housing body 202.

The first electrical connector 100 can further include at least one such as a plurality of power contact inserts 212. For instance, the power contact inserts 212 are configured to be received in the first connector housing 200, for instance in the cavity 210. Alternatively, First connector housing 200 may comprise two or more power contact inserts 212 coupled together along the lateral direction A. The power contact inserts 212 are configured to support respective ones of the electrical power contacts 204. The first housing body 202 can include at least one such as a plurality of inner divider walls that extend along the transverse direction T between the upper and lower ends 200*e* and 200*f* in the in the cavity 210, and are spaced from each other along the lateral direction A. The inner divider walls thus divide the cavity 210 a plurality of, such as two or more, compartments, each compartment sized to receive a respective one of the plurality of power contact inserts 212. It should be appreciated that the power contact inserts 212 can be configured to support any number of electrical power contacts 204 as desired.

For example, a first power contact insert 212*a* can be configured to support a respective one of the electrical power contacts 204 that includes a pair resilient contact beams that are spaced along the transverse direction T. Each of the pair of beams can be forked so as to define a respective split beam. The electrical power contact 204 can be coupled to a respective one of the power cables 250*a*. In accordance with the illustrated embodiment, the first power contact inserts 212 can define a cavity 214*a* configured to receive the respective power contacts 204. The electrical power contacts 204 can further include a retention tab 216*a* that is configured to secure the electrical power contacts 204 in place within the cavity 214*a* of the respective first power contact inserts 212*a*. For instance, the first power contact insert 212*a* defines respective openings 218*a* that extend along the transverse direction T and are sized and configured to receive the retention tabs 216*a*. The first power contact insert 212*a* can be inserted into a respective compartment in the cavity 210. One or both of the first connector housing 200 and the first power contact insert 212*a* can include retention members such that the first power contact insert 212*a* is retained in an inserted position in the respective cavity 210 such that the mating ends of the two pairs of electrical power contacts 204 will be disposed substantially at the power mating interface 208.

The first electrical connector 100 can include a second power contact insert 212*b* that can be configured to support a single pair of electrical power contact 204 including a pair of transversely spaced resilient contact beams that are not forked, and thus define a solid beam. The second power contact insert 212*b* can be constructed as described above with respect to the first power contact insert 212*a*, but can define a lesser width that the first power contact insert 212*a* along the lateral direction A. For instance, the power contacts 204 supported by the second power contact insert 212*b* can defined a lesser width (for instance half) along the lateral direction A with respect to the power contacts 204 supported by the first power contact inserts 212*a*. Thus, the width of the second power contact inserts 212*b* can be substantially half the width of the first power contact inserts 212*a*. It should further be appreciated that the first connector housing 200 is not limited to the first and second power contact inserts 212*a* and 212*b*, and that the plurality of electrical power contacts 204 can be otherwise disposed into the first connector housing 200, for instance by stitching the electrical power contacts 204 into the housing body 202. Furthermore, the first connector housing 200 can include only first power contact inserts 212*a* and no second power contact inserts 212*b*, and conversely can include only second power contact inserts 212*b* and no first power contact inserts 212*a*.

Figure 3A:
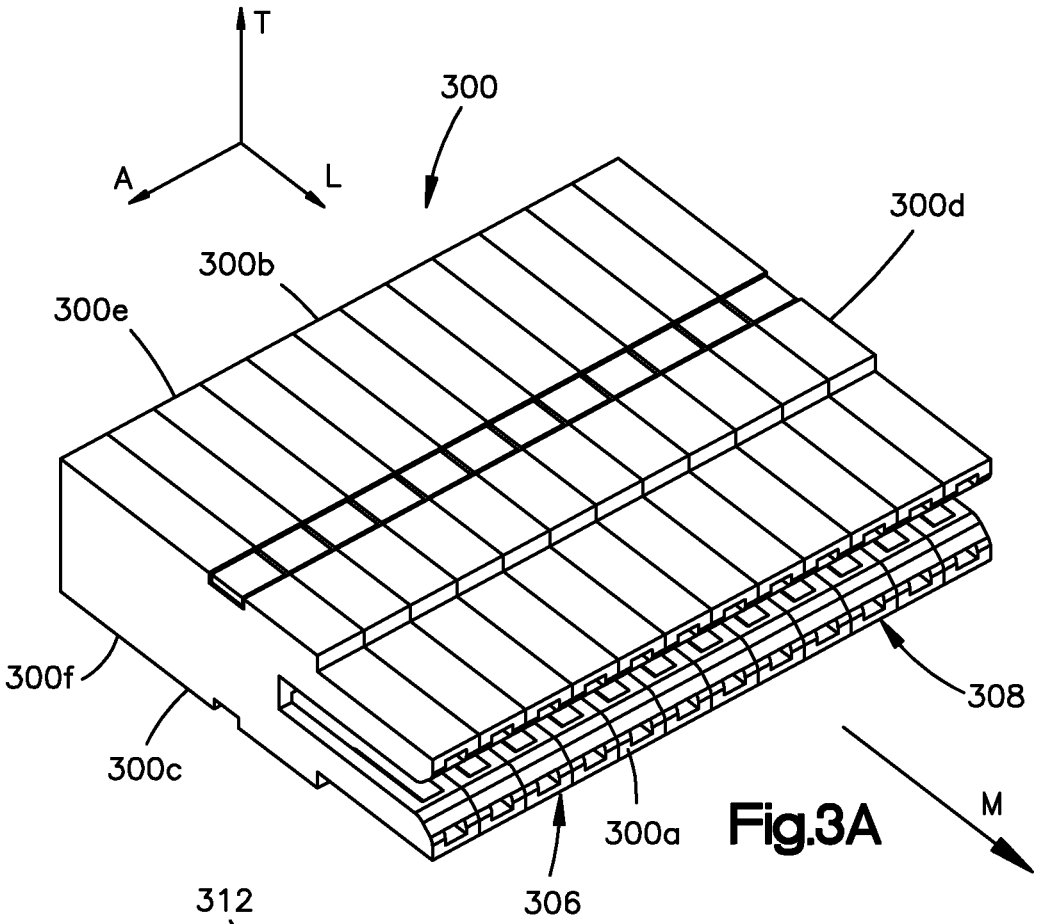
FIGS. 3A-B are perspective views of the signal connector housing illustrated in FIG. 1 and a signal contact insert configured to be disposed in the signal connector housing.
Figure 3B:
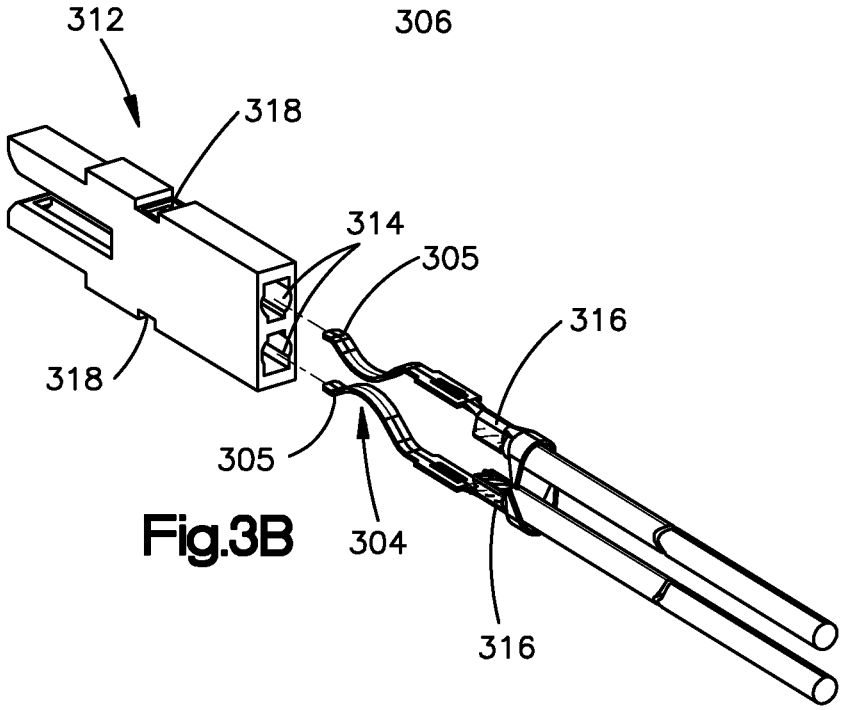

Referring now to FIGS. 3A-B, the second connector housing 300 includes a second housing body 302 that defines a front end 300*a*, an opposed rear end 300*b* that is spaced from the front end 300*a* along the longitudinal direction L, opposed first and second sides 300*c* and 300*d* that are spaced apart from each other along the lateral direction A, an upper end 300*e*, and an opposed lower end 300*f* that is spaced from the upper end 300*e* along the transverse direction T.

The second connector housing 300 can define a receptacle 306 that extends into the front end 300*a* of the second housing body 302 along the longitudinal direction L. For instance, the receptacle 306 can extend through one or both of the first and second sides 300*c* and 300*d*. The front end 300*a* of the second housing body 302 can define a signal mating interface 308, such that the receptacle 306 can be disposed at the signal mating interface 308. The second connector housing 300, and thus the first electrical connector 100, is configured to mate with a complementary electrical device at the signal mating interface 308. For example, in accordance with the illustrated embodiment, the signal mating interface 308 can be configured to receive at least a portion of a substrate 700, such as a printed circuit board 702, that is inserted into the receptacle 306. Therefore, the receptacle 306 can be said to extend into the second connector housing 300 along a mating direction M that can be, for instance, the longitudinal direction L. As described above, the receptacle 306 can be open at the first and second sides 300*c* and 300*d* of the second connector housing 300. Therefore, it can also be said that the receptacle 306 extends into the front end 300*a* along a second direction that can be, for instance, the lateral direction A, such that the signal mating interface 308 is open at the first and second sides 300*c* and 300*d* of the second connector housing 300.

The electrical signal contacts 304 can define respective mating ends 305 configured to be mated to the electrical device that is mated to the second connector housing 300, and respective mounting ends that are configured to be placed in electrical connection with respective ones of the signal cables 350. The electrical signal contacts 304 can be supported by the housing body 302 such that the respective mating ends 305 are disposed in the receptacle 306 at the signal mating interface 308. The second connector housing 300 can further define at least one cavity 310 that extends into the rear end 300*b* of the housing body 302. The cavity 310 can be defined by an upper wall disposed at the upper end 300*e*, a lower wall disposed at the lower end 300*f*, and opposed side walls disposed at the first and second sides 300*c* and 300*d* of the second housing body 302.

The first electrical connector 100 can further include at least one such as a plurality of signal contact inserts 312. For instance, the signal contact inserts 312 are configured to be received in the second connector housing 300, for instance in the cavity 310. Second connector housing 300 may also comprise two or more signal contact inserts 312 coupled together along the lateral direction A. The signal contact inserts 312 are configured to support respective ones of the electrical signal contacts 304. The second housing body 302 can include at least one such as a plurality of inner divider walls that extend along the transverse direction T between the upper and lower ends 300*e* and 300*f* in the in the cavity 310, and are spaced from each other along the lateral direction A. The inner divider walls thus divide the cavity 310 a plurality of, such as two or more, compartments, each compartment sized to receive a respective one of the plurality of signal contact inserts 312. It should be appreciated that the signal contact inserts 312 can be configured to support any number of electrical signal contacts 304 as desired.

For example, the signal contact insert 312 can be configured to support a respective one of the electrical signal contacts 304 that includes a pair of resilient contact beams that are spaced apart along the transverse direction T. Each contact beam of the electrical signal contact 304 can be coupled to a respective one of the signal cables 350. In accordance with the illustrated embodiment, the signal contact insert 312 can define a pair of cavities 314 configured to receive the respective contact beams of the electrical signal contact 304. Each contact beam of the electrical signal contact 304 can further include a retention tab 316 that is configured to secure the electrical respective contact beam of the electrical signal contact 304 in place within a respective one of cavities 314 of the respective signal contact insert 312. For instance, the signal contact insert 312 defines a pair of openings 318 that extend into the signal contact insert 312 along the transverse direction T, each of the openings 318 open to a respective one of the cavities 314 and sized and configured to receive a respective one of the retention tabs 316 so as to secure the respective contact beam in place within the signal contact insert 312. The signal contact insert 312 can be inserted into a respective compartment in the cavity 310. One or both of the second connector housing 300 and the signal contact insert 312 can include retention members such that the signal insert 312 is retained in an inserted position in the respective cavity 310 such that the mating ends 305 of the electrical signal contact 304 will be disposed substantially at the signal mating interface 308.

In accordance with the illustrated embodiment, the second connector housing 300 is configured to support twelve signal connector inserts 312, disposed into the cavity 310 adjacent to one another along the lateral direction A. It should be appreciated that the second connector housing 300 is not limited to the illustrated twelve signal connector inserts 312, and that the second connector housing 300 can be alternatively constructed with any number of signal connector inserts 312 disposed within the cavity 310 along the lateral direction A in any arrangement as desired. It should further be appreciated that the second connector housing 300 is not limited to the signal connector inserts 312, and that the plurality of electrical signal contacts 304 can be otherwise disposed into the second connector housing 300, for instance by stitching the electrical signal contacts 304 into the second housing body 302.

Figure 4A:
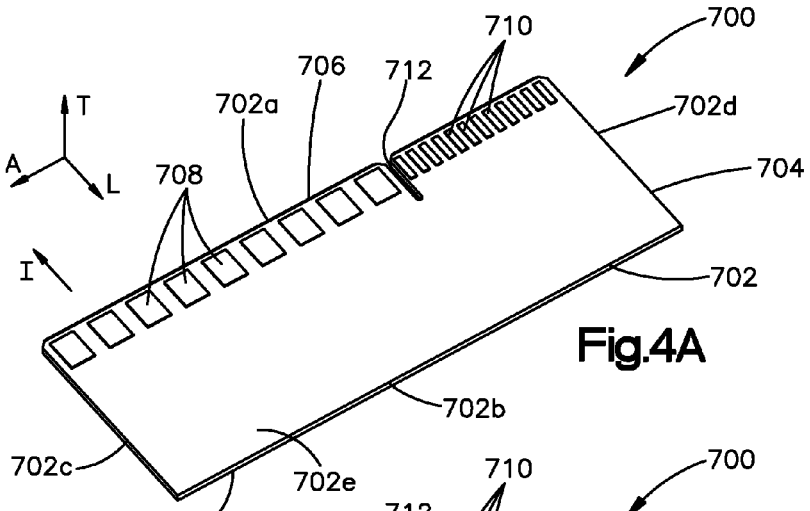
FIGS. 4A-C are perspective views of printed circuit boards configured to be mated to various embodiments of the electrical assembly illustrated in FIG. 1.
Figure 4B:
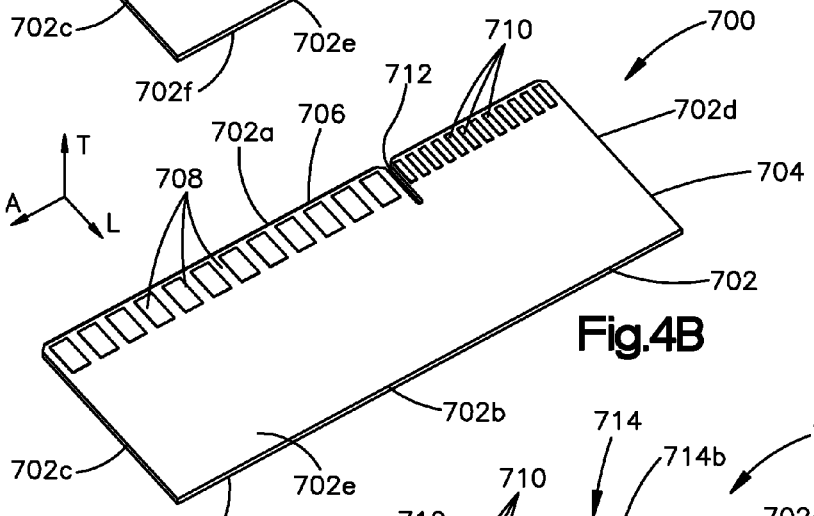
Figure 4C:
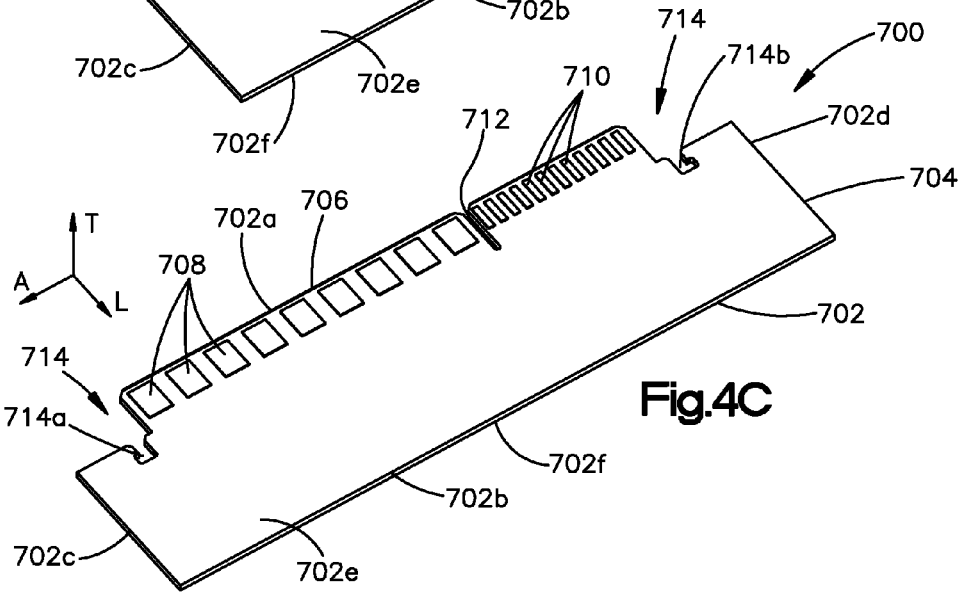

Referring generally now to FIGS. 4A-C, the first electrical connector 100 can be configured to be mated to a substrate 700 such as printed circuit board 702. The printed circuit board 702 can include a body 704 that defines a first end 702*a*, an opposed second end 702*b* that is spaced from the first end 702*a* along the longitudinal direction L, first and second opposed sides 702*c* and 702*d* spaced apart from each other along the lateral direction A, and opposed upper and lower surfaces 702*e* and 702*f* that are spaced apart from each other along the transverse direction T. The first end 702*a* of the printed circuit board can define a leading edge 706 of the printed circuit board configured to be inserted into at least one or both of the recesses 206 and 306 of the first and second connector housings 200 and 300. At least one or both of the upper and lower surfaces 702*e* and 702*f* can include respective pluralities of at least one or both of electrical power contact pads 708 and electrical signal contact pads 710 affixed to the respective upper and lower surfaces 702*e* and 702*f*. The electrical power contact pads 708 and electrical signal contact pads 710 can be electrically connected to conductive traces that extend through the body 704, and can be configured to engage with respective ones of the pluralities of electrical power contacts 204 and electrical signal contacts 304 when the first electrical connector 100 is mated to the printed circuit board 702, thereby placing the first electrical connector 100 into electrical communication with the conductive traces in the body 704.

In accordance with the illustrated embodiments, the printed circuit board 702 can include a plurality of electrical power contact pads 708 and a plurality of electrical signal contact pads 710 disposed along the leading edge 706 on the upper and lower surfaces 702*c* and 702*d*. In accordance with a first embodiment illustrated in FIG. 4A, the upper and lower surfaces 702*e* and 702*f* of the printed circuit board 702 include a plurality of electrical power contact pads 708 comprising nine pairs of power contact pads 708 spaced apart from each other along the lateral direction A and a plurality of electrical signal contact pads 710 comprising twelve pairs of signal contact pads 710 spaced apart from each other along the lateral direction A. The body 704 can define a notch 712 that extends into the first end 702*a* along the longitudinal direction L, the notch 712 disposed between the plurality of electrical power contact pads 708 and the plurality of electrical signal contact pads 710. The first notch can receive an interconnect member 500.

In accordance with a second embodiment illustrated in FIG. 4B, the upper and lower surfaces 702*e* and 702*f* of the printed circuit board 702 include a plurality of electrical power contact pads 708 comprising twelve pairs of power contact pads 708 spaced apart from each other along the lateral direction A and a plurality of electrical signal contact pads 710 comprising twelve pairs of signal contact pads 710 spaced apart from each other along the lateral direction A. The body 704 can define a notch 712 that extends into the first end 702*a* along the longitudinal direction L, the notch 712 disposed between the plurality of electrical power contact pads 708 and the plurality of electrical signal contact pads 710.

Referring now to FIG. 4C, the body 704 can further define at least one, such as a plurality of latch openings 714, the latch openings 714 configured to engage with respective ones of the end members 400, as described in more detail below. In accordance with the illustrated embodiment, the body 704 defines a pair of latch openings 714 defined along the leading edge 706, including a first latch opening 714*a* disposed between the first side 702*c* and the plurality of power contact pads 708 and a second latch opening 714*b* disposed between the second side 702*d* and the plurality of signal contact pads 710.

Referring generally now to FIGS. 5A-D, the first electrical connector 100 can include at least one, such as a plurality of modular members which can be utilized to configure the first electrical connector 100 as an electrical connector, and more particularly as a cable electrical connector. The modular members of the first electrical connector 100 can include at least one, such as a pair of end members 400, at least one interconnect member 500, and at least one spacer member 600. The modular members, including the end member 400, the interconnect member 500, and the spacer member 600 can be made of any suitable material as desired, such as an electrically insulative material such as plastic or the like.

Figure 5B:
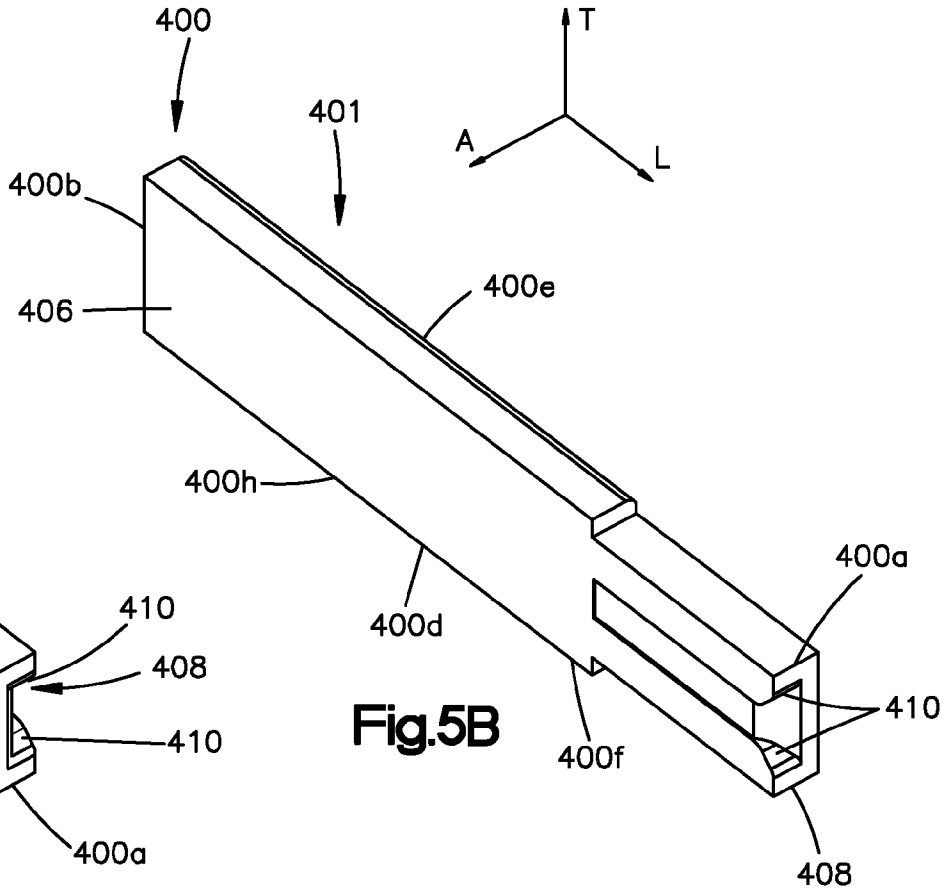
FIGS. 5A-D are perspective views of the closure members illustrated in FIG. 1.
Figure 5A:
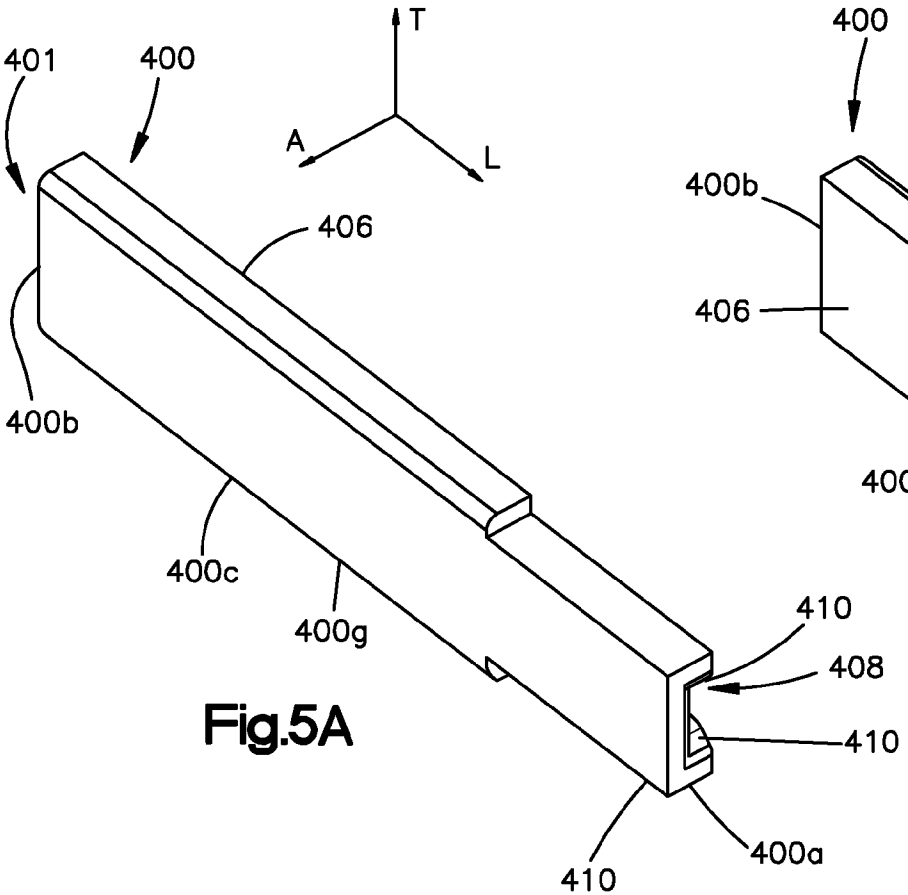

Referring now to FIGS. 5A-B, the end member 400 can be configured to be coupled to the first or second sides 200*c* and 200*d* of the first connector housing 200 so as to close the respective receptacle 206 at the respective first or second sides 200*c* and 200*d* of the first connector housing 200, and to be coupled to the first or second sides 300*c* and 300*d* of the second connector housing 300 so as to close the respective receptacle 306 at the respective first or second sides 300*c* and 300*d* of the second connector housing 300. For example, in accordance with the electrical assembly illustrated in FIG. 1, a first end member 400 can be coupled to the first side 200*c* of the first connector housing 200, thereby closing the open end of the receptacle 206 at the first side 200*c* of the first connector housing 200. Similarly, a second end member 400 can be coupled to the second side 300*c* of the second connector housing 300, thereby closing the open end of the receptacle 306 at the second side 300*d* of the second connector housing 300. In accordance with the illustrated embodiments, the end member 400 can be coupled to the first or second connector housings 200 or 300 utilizing an ultrasonic welding process, an interference fit, or an integral mold. However the end member 400 can also be coupled to a respective one of the first or second connector housings 200 or 300 using any other suitable method as desired. For example, the end member 400 can include at least one, such as a plurality of coupling members configured to engage with complementary coupling members supported by one or both of the first and second sides 200*c* and 200*d* of the first connector housing 200 and with complementary coupling members supported by one or both of the first and second sides 300*c* and 300*d* of the second connector housing 300.

The end member 400 can be differently constructed in accordance with particular embodiments of the end member 400. For instance, accordance with one embodiment, the end member 400 can be constructed as an end member 401. Each end member 400 includes an end member body 406 that defines a front end 400*a*, an opposed rear end 400*b* that is spaced from the front end 400*a* along the longitudinal direction L, an outer side 400*c*, an opposed inner side 400*d* that is spaced from the outer side 400*c* along the lateral direction A, an upper end 400*e*, and an opposed lower end 400*f* that is spaced from the upper end 400*e* along the transverse direction T. The outer side 400*c* can define an outer side surface 400*g* and the inner side 400*d* can define an inner side surface 400*h*.

The end member body 406 can define any suitable shape as desired. For example, in accordance with the illustrated embodiment, the end member body 406 can be sized to match the first and second sides 200*c* and 200*d* of the first connector housing 200. Stated differently, the end member body 406 can have a cross sectional profile in a plane defined along the longitudinal direction L and the transverse direction T that is substantially the same as that of the first or second ends 200*c* or 200*d* of the first connector housing 200. The end member body 406 can be configured to receive at least a portion of the printed circuit board 702 when the electrical assembly is mated to the printed circuit board 702. For example, in accordance with the illustrated embodiment, the end member body 406 defines a recess 408 extends that extends into the front end 400*a* along the longitudinal direction L and into the inner side surface 400*h*. The recess 408 can define at least one, such as a plurality of bevelled surfaces 410 proximate the front end 400*a*, the bevelled surfaces 410 configured to guide the printed circuit board 702 into alignment within the respective recesses 206 and 306 of the first and second connector housing 200 and 300 during mating of the first electrical connector 100 to the printed circuit board 702.

Figure 5D:
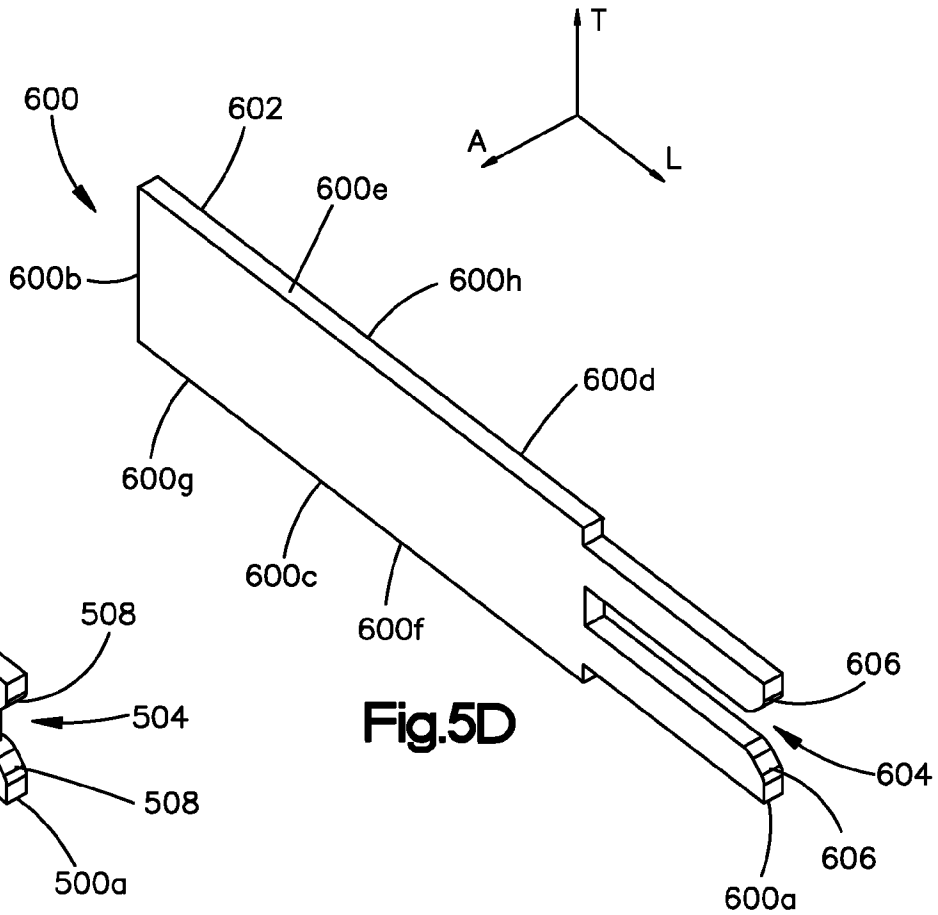
Figure 5C:
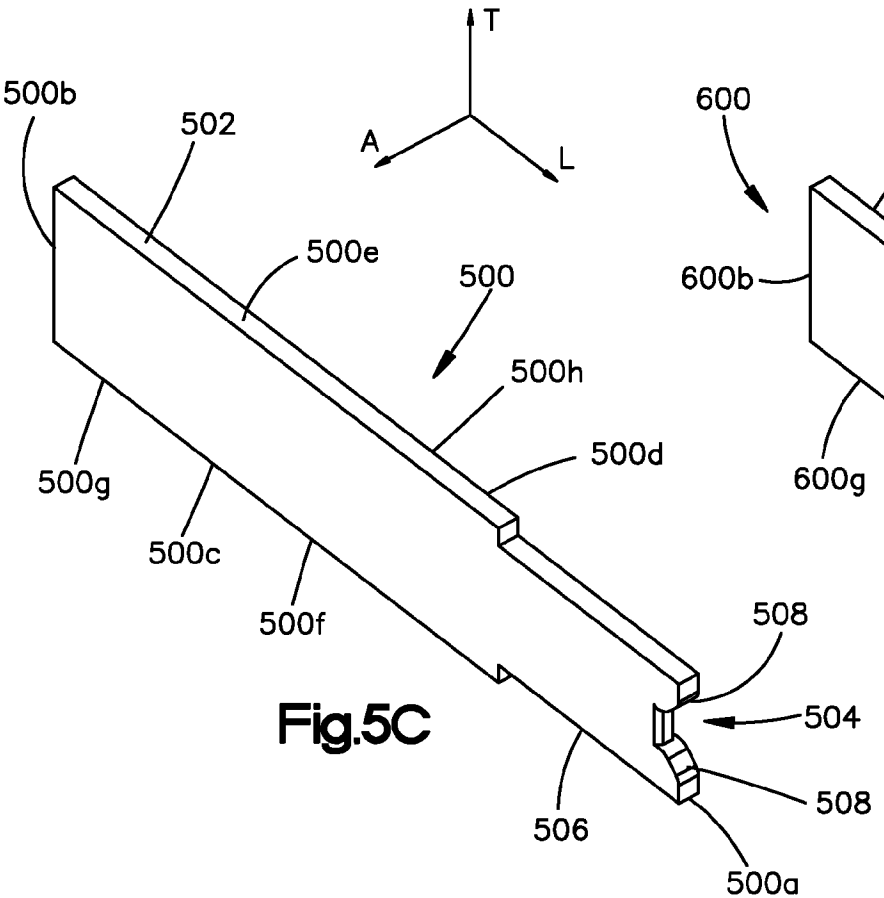

Referring now to FIG. 5C, the interconnecting member 500 can be configured to be disposed between respective ones of the first or second connector housings 200 or 300 so as to couple the respective ones of the first or second connector housings 200 or 300 to one another. For example, in accordance with the first electrical connector 100 illustrated in FIG. 1, the interconnect member 500 can be coupled to the second end 200*d* of the first connector housing 200 and to the first end 300*c* of the second connector housing 300. The illustrated interconnect member 500 includes an interconnect member body 502 that defines a front end 500*a*, an opposed rear end 500*b* that is spaced from the front end 500*a* along the longitudinal direction L, opposed first and second sides 500*c* and 500*d* that are spaced from each other along the lateral direction A, an upper end 500*e*, and an opposed lower end 500*f* that is spaced from the upper end 500*e* along the transverse direction T. The first side 500*c* can define a first side surface 500*g* and the second side 500*d* can define a second side surface 500*h*.

The interconnect member body 502 can define any suitable shape as desired. For example, in accordance with the illustrated embodiment, the interconnect member body 502 can have a cross sectional profile in a plane defined along the longitudinal direction L and the transverse direction T that is substantially the same as that of the first connector housing 200. The interconnect member 500 can be configured so that a portion of the interconnect member body 502 is received by a complementary portion of the printed circuit board 702 when the first electrical connector 100 is mated to the printed circuit board 702. For example, in accordance with the illustrated embodiment, the interconnect member body 502 defines a recess 504 that extends into the front end 500*a* along the longitudinal direction L. The recess 504 can define a shorter depth along the longitudinal direction L than a depth along the longitudinal direction L of one or both of the recesses 206 and 306, such that an intermediate portion 506 of the interconnect member body 502 is received in the notch 712 of the printed circuit board 702. The intermediate portion 506 can act to ensure proper alignment of the first electrical connector 100 relative to the printed circuit board 702 as the first electrical connector 100 is mated to the printed circuit board 702. The recess 504 can further define at least one, such as a pair of bevelled surfaces 508 proximate the front end 500*a*, the bevelled surfaces 508 configured to guide the printed circuit board 702 into alignment within the respective recesses 206 and 306 of the first and second connector housing 200 and 300 during mating of the first electrical connector 100 to the printed circuit board 702.

In accordance with the illustrated embodiment, the interconnect member 500 can be coupled to the first and second connector housings 200 and 300 utilizing an ultrasonic welding process. However the interconnect member 500 can be configured to couple the first and second connector housings 200 and 300 to one another using any other suitable method as desired. For example, the interconnect member 500 can include at least one, such as a plurality of coupling members configured to engage with complementary coupling members supported by respective the first and second sides 200*c* and 200*d* of the first connector housing 200 and the first and second sides 300*c* and 300*d* of the second connector housing 300.

Referring now to FIG. 5D, the spacer member 600 can be configured to be disposed between respective ones of the first or second connector housings 200 or 300 and respective ones of the end members 400 so as to couple the respective ones of the first or second connector housings 200 or 300 to the respective ones of the end members 400. For example, in accordance with the first electrical connector 100 illustrated in FIG. 1, the spacer member 600 can be coupled to the second end 300*d* of the second connector housing 300 and to the inner side 400*d* of a respective one of the end members 400. The illustrated spacer member 600 includes a spacer member body 602 that defines a front end 600*a*, an opposed rear end 600*b* that is spaced from the front end 600*a* along the longitudinal direction L, opposed first and second sides 600*c* and 600*d* that are spaced from each other along the lateral direction A, an upper end 600*e*, and an opposed lower end 600*f* that is spaced from the upper end 600*e* along the transverse direction T. The first side 600*c* can define a first side surface 600*g* and the second side 600*d* can define a second side surface 600*h*.

The spacer member body 602 can define any suitable shape as desired. For example, in accordance with the illustrated embodiment, the spacer member body 602 can have a cross sectional profile in a plane defined along the longitudinal direction L and the transverse direction T that is substantially the same as that of the first connector housing 200. The spacer member 600 can be configured so that a portion of the spacer member body 602 receives at least a portion of the printed circuit board 702 when the first electrical connector 100 is mated to the printed circuit board 702. For example, in accordance with the illustrated embodiment, the spacer member body 602 defines a recess 604 that extends into the front end 600*a* along the longitudinal direction L. The recess 604 can define a depth along the longitudinal direction L that is substantially equal to the depth along the longitudinal direction L of one or both of the recesses 206 and 306. The recess 604 can further define at least one, such as a pair of bevelled surfaces 606 proximate the front end 600*a*, the bevelled surfaces 606 configured to guide the printed circuit board 702 into alignment within the respective recesses 206 and 306 of the first and second connector housing 200 and 300 during mating of the first electrical connector 100 to the printed circuit board 702.

In accordance with the illustrated embodiment, the spacer member 600 can be coupled to the second end 300*d* of the second connector housing 300 and to the inner side 400*d* of a respective one of the end members 400 utilizing an ultrasonic welding process. However the spacer member 600 can be configured to be coupled to the first and second connector housings 200 or 300 using any other suitable method as desired. For example, the spacer member 600 can include at least one, such as a plurality of coupling members configured to engage with complementary coupling members supported by respective the first and second sides 200*c* and 200*d* of the first connector housing 200 and the first and second sides 300*c* and 300*d* of the second connector housing 300. In accordance with an alternative embodiment, the spacer member 600 can be configured to define a closure member that closes the corresponding receptacle 306 when the spacer member 600 is affixed to the second connector housing 300.

Figure 6:
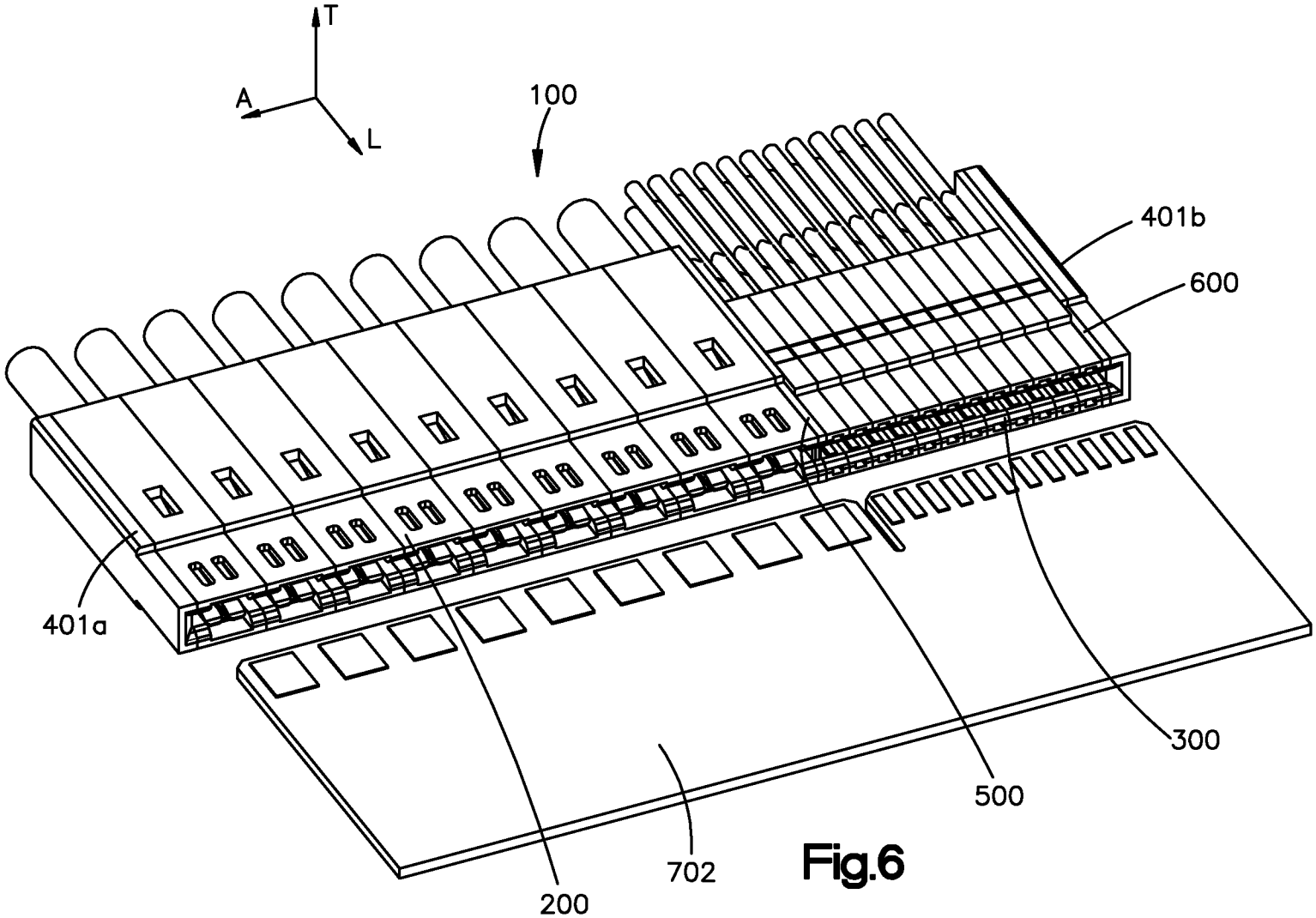
FIG. 6 is a perspective view of the electrical assembly illustrated in FIG. 1 mated to the printed circuit board illustrated in FIG. 4A.

Referring now to FIG. 6, the assembled electrical connector 100 can be mated to a printed circuit board 702. In accordance with a method of constructing the first electrical connector 100, a first end member 401*a* can be affixed to the first side 200*c* of the first connector housing 200, thereby closing the power mating interface 208 at the first side 200*c*. The method can further include affixing an interconnect member 500 to the second side 200*d* of the first connector housing 200 and the first side 300*c* of the second connector housing 300, thereby coupling the first connector housing 200 to the second connector housing 300. The method can further include affixing the first side 500*c* of a spacer member 500 to the second end 300*d* of the second connector housing 300 and affixing a second end member 401*b* to the second side 500*d* of the spacer member 500, thereby closing the signal mating interface 308 proximate the second side 300*d*. In an alternative embodiment omitting the spacer member 600, a second end member 401*b* can be affixed to the second side 300*d* of the second connector housing 300, thereby closing the signal mating interface 308 at the second side 300*d*.

In accordance with the illustrated embodiment, the above described steps of affixing components of the first electrical connector 100 to one another can comprise affixing the components to one another using at least one, such as a series of ultrasonic welding processes. For example, all of the components of the first electrical connector 100 can be aligned relative to one another, for example by placing the components into a jig, and can the first electrical connector 100 can be subjected to a single ultrasonic welding process. Alternatively, the components of the first electrical connector 100 can be ultrasonically welded to one another in any order using any number of ultrasonic welding processes as desired. Alternatively still, at least two, such as all of the components of the first electrical connector 100 can include the above described coupling members and constructing the first electrical connector 100 can include one or both of mechanical connecting complementary coupling members of components of the first electrical connector 100 and one or more ultrasonic welding processes.

Figure 7B:
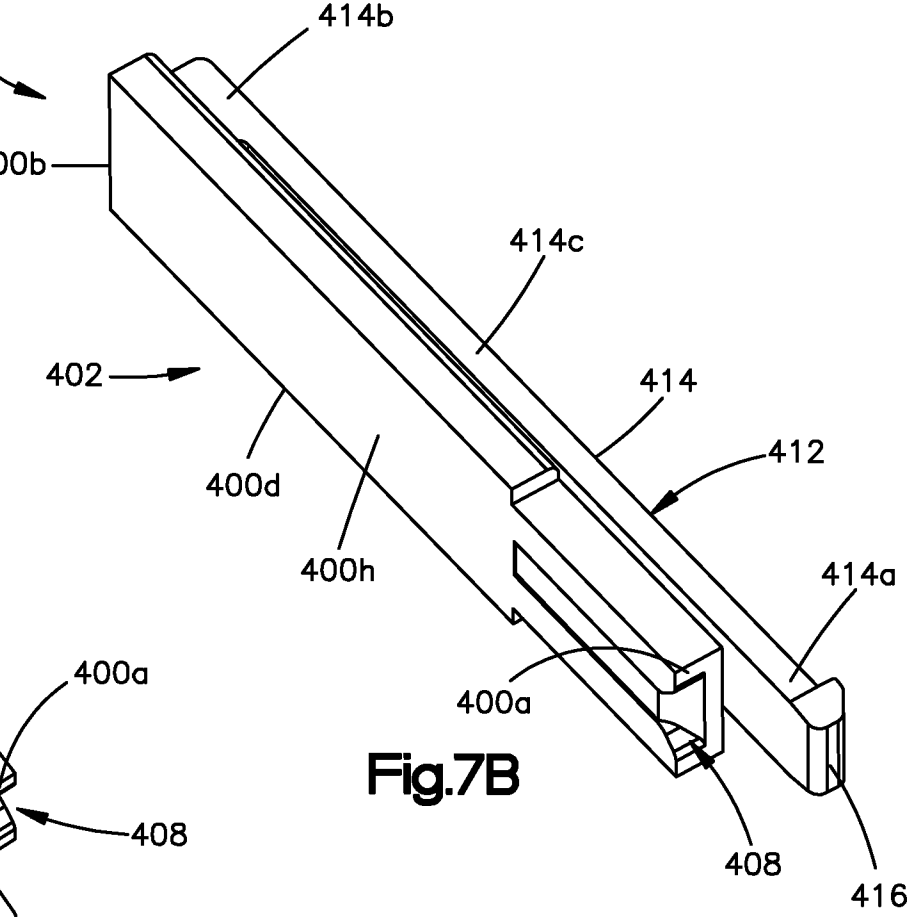
FIGS. 7A-B are perspective views of closure members constructed in accordance with an alternative embodiment.
Figure 7A:
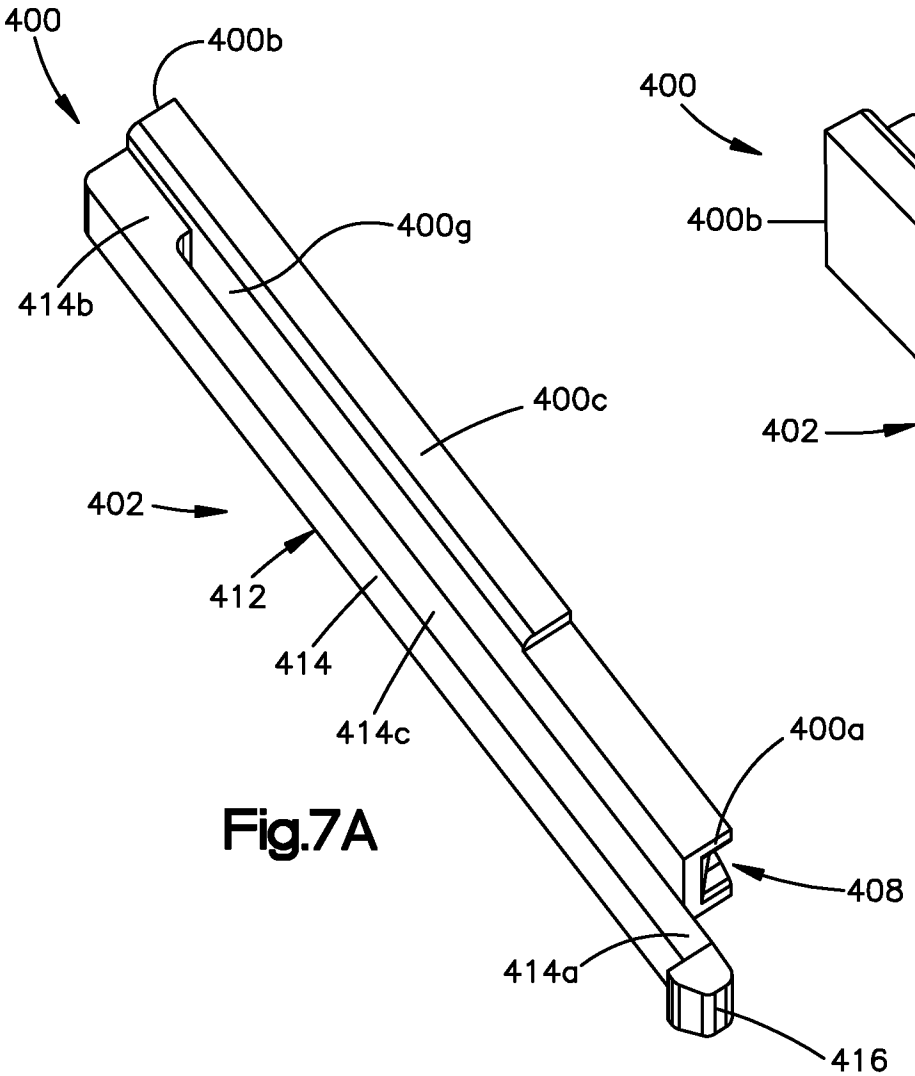

Referring now to FIGS. 7A-B, the end member 400 can be configured to releasably latch to the printed circuit board 702 when the first electrical connector 100 is mated to the printed circuit board 702. For example, the end member 400 can be constructed as an end member 402 that supports at least one latching member 412. The body of the end member 402 can include an end member body 406 that is constructed substantially the same as the end member body 406 of the end member 401, with the exception of the addition of at least one latching member 412 supported by the end member body 406. In accordance with the illustrated embodiment, the at least one latching member 412 comprises a resilient latch arm 414 that includes a rear end 414*b* that extends outward from the outer side surface 400*g* along the lateral direction A, a forward end 414*a* that is spaced from the rear end 414*b* along the longitudinal direction A, and an intermediate portion 414*c* that extends from the rear end 414*b* to the front end 414*a*. The rear end 414*b* can extend outward from the outer side surface 400*g* a distance along the lateral direction A such that the latch arm 414 is spaced from the outer side surface 400*g* sufficiently to allow the forward end 414*a* to be biased inward toward the outer side surface 400*g* during operation of the latching arm 414, as described in more detail below. In an embodiment, rear end 414*b* may be proximate to rear end 400*b* or located a distance from both the front end 400*a* and rear end 400*b*. The latch arm 414 can include a hook 415 disposed substantially at the front end 414*a*. The hook 415 may further define a leading engagement surface 415*a* and a trailing engagement surface 415*b*, the trailing engagement surface 415*b* extending from a surface of the latch arm 414 opposite the connector housing 100.

The latch arm 414 can have a length along the longitudinal direction L, as defined by the front and rear ends 414*a* and 414*b*, such that the front end 414*a* is disposed forward of the front ends 200*a* and 300*a* of the first and second connector housings 200 and 300, and can be received in a respective latch opening 714 of the printed circuit board 702 (see FIG. 4C) when the first electrical connector 100 is mated to the printed circuit board 702. For example, in accordance with the illustrated embodiment, the length of the latch arm 414 along the longitudinal direction is longer than corresponding lengths along the longitudinal direction L of the first connector housing 200, as defined by the front and rear ends 200*a* and 200*b*, and the second connector housing 300, as defined by the front and rear ends 300*a* and 300*b*.

Figures 8A, 8B, 8C:
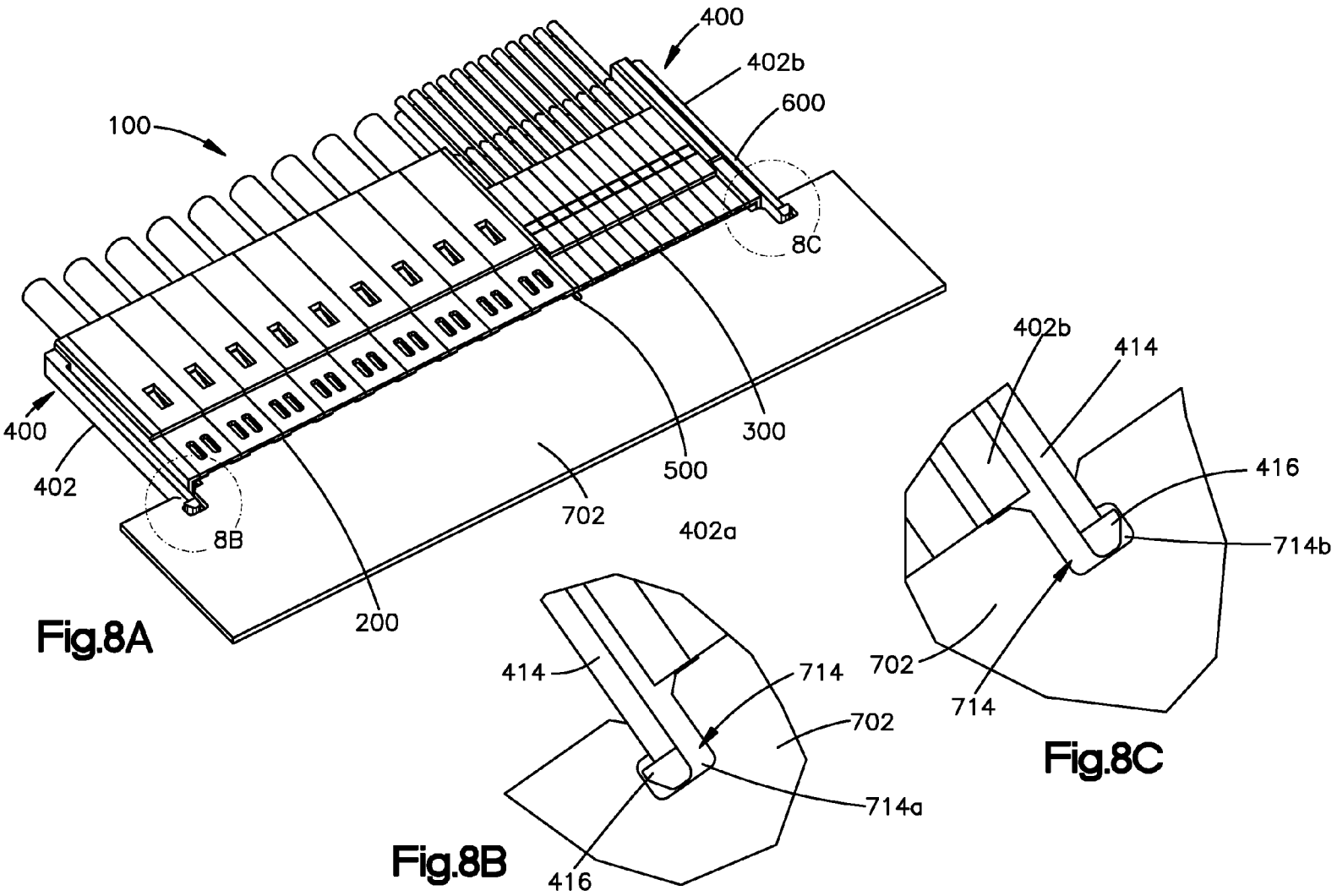
FIG. 8A-C are perspective views of an electrical assembly constructed in accordance with the an alternative embodiment utilizing the closure members illustrated in FIGS. 7A-B and mated to the printed circuit board illustrated in FIG. 4C.
Figures 9A, 9B:
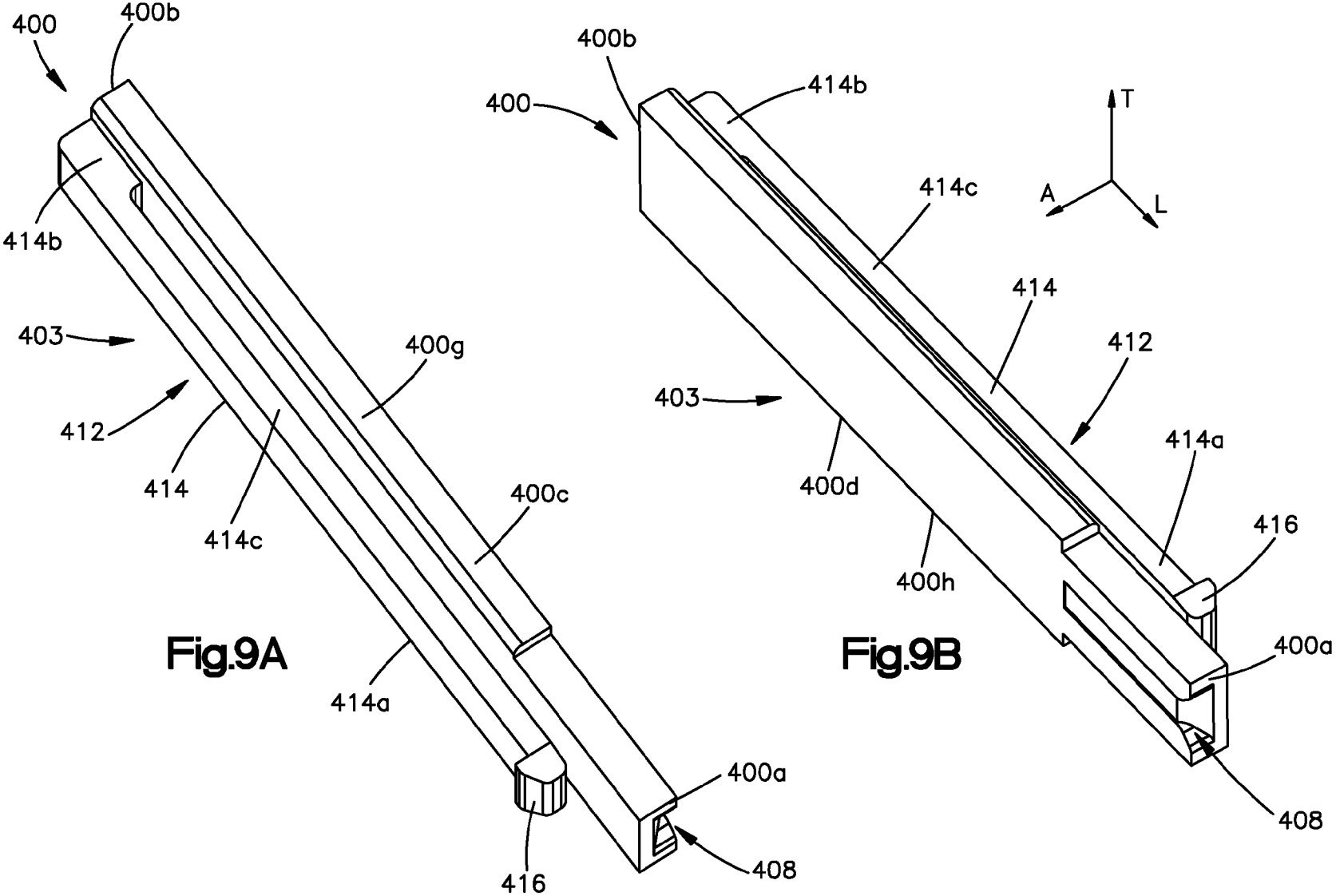
FIGS. 9A-B are perspective views of modular closure members constructed in accordance with another alternative embodiment.

Referring now to FIGS. 8A-C, the first electrical connector 100 can be constructed in accordance with an alternative embodiment wherein the first and second end members 401*a* and 401*b* (see FIG. 6) are replaced with first and second end members 402*a* and 402*b*. The illustrated embodiment of the first electrical connector 100 can be assembled as described elsewhere herein, for instance with reference to the first electrical connector 100 illustrated in FIG. 6. The electrical assembly illustrated in FIG. 8A can be mated to the printed circuit board 702 illustrated in FIG. 4C by inserting the printed circuit board 702 into the recesses 206 and 306 along the mating direction M as described above. As the printed circuit board 702 is inserted, the hooks 415 of the respective latch arms 414 of the first and second end members 402*a* and 402*b* will come into contact with respective ones of the latch openings 714*a* and 714*b*, causing the latch arms 414 to be biased inward along the lateral direction A. As the printed circuit board 702 advances further into the recesses 206 and 306, the hooks 415 will be disposed fully into respective ones of the latch openings 714*a* and 714*b*. The latch arms 414 will then resiliently snap back into their original non-biased orientations, thereby releasably locking the first electrical connector 100 onto the printed circuit board 702. It should be appreciated that the first electrical connector 100 is not limited to the illustrated latching members 412, and that the end member 402 can alternatively be constructed with any other suitable latching members as desired. The disclosure of U.S. Patent Application Publication Nos. 2010/0197166 and 2010/0184339 are both incorporated by reference as if set forth in their entireties herein.

Referring now to FIGS. 9A-B and 10A-C, the first electrical connector 100 can be configured to be mated to a second electrical connector 800 mounted to the printed circuit board 702. The end member 400 can be configured to releasably latch to the second electrical connector 800 when the first electrical connector 100 is mated to the second electrical connector 800. For example, the end member 400 can be constructed as an end member 403. The end member 403 can be constructed substantially the same as the end member 402, but with a latching arm 414 that has a shorter length along the longitudinal direction L than the length along the longitudinal direction L of the latching arm 414 of the end member 402. In accordance with the illustrated embodiment, the latch arm 414 of the end member 403 can have a length along the longitudinal direction L, as defined by the front and rear ends 414*a* and 414*b*, such that the front end 414*a* is disposed rearward of the front ends 200*a* and 300*a* of the first and second connector housings 200 and 300, and can be received in a respective latch opening of the second electrical connector 800 when the first electrical connector 100 is mated to the second electrical connector 800. For example, the length of the illustrated latch arm 414 along the longitudinal direction L is shorter than the corresponding lengths along the longitudinal direction L of the first connector housing 200, as defined by the front and rear ends 200*a* and 200*b*, and the second connector housing 300, as defined by the front and rear ends 300*a* and 300*b*.

The second electrical connector 800 can include at least one or both of pluralities of electrical power contacts and pluralities electrical signal contacts that are configured to mate with the respective pluralities of electrical power contacts 204 and electrical signal contacts 304. For example, the second electrical connector 800 can include respective pluralities of electrical power contacts and electrical signal contacts that include blade type contact beams configured to be received between the resilient beams of corresponding pairs of electrical power contacts 204 and electrical signal contacts 304.

It should be appreciated the second electrical connector 800 can be constructed similarly to the first electrical connector 100. For example, in accordance with the illustrated embodiment, the second electrical connector 800 can include end members 400' that are configured to engage with the latch arms 414 of the end members 403. For example, in accordance with the illustrated embodiment, the end members 400' can define latch openings 402' that are configured to receive and engage with respective hooks 415 of the latch arms 414 of the end members 403. The second electrical connector 800 can further include first and second connector housings 200' and 300' that support respective pluralities of electrical power contacts and electrical signal contacts and are configured as right angle connector housings. The second electrical connector 800 can further include an interconnect member 500' and a spacer member 600'. The second electrical connector 800 can be constructed as described elsewhere herein, for instance with reference to the first electrical connector 100 illustrated in FIG. 6. It should further be appreciated that the second electrical connector 800 is not limited to the illustrated right angle configuration, and that the second electrical connector 800 can alternatively be constructed as any other type of electrical connector, such as a vertical electrical connector.

Figure 10B:
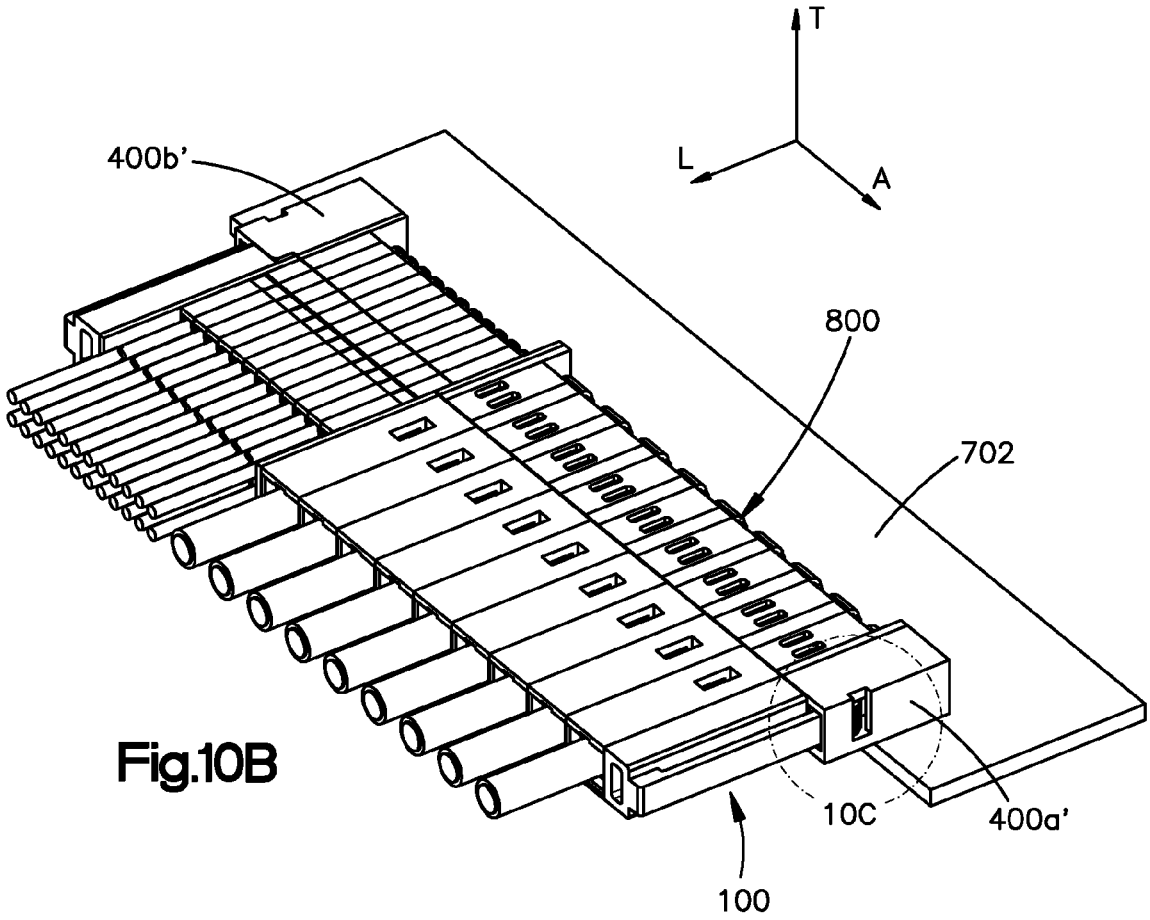
FIGS. 10B-C are perspective views of the first and second electrical assemblies illustrated in FIG. 10A mated to one another.
Figure 10C:
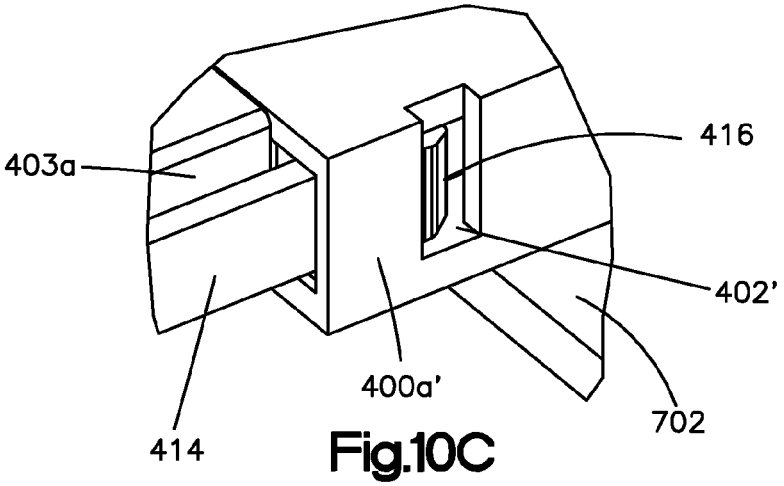
Figure 11B:
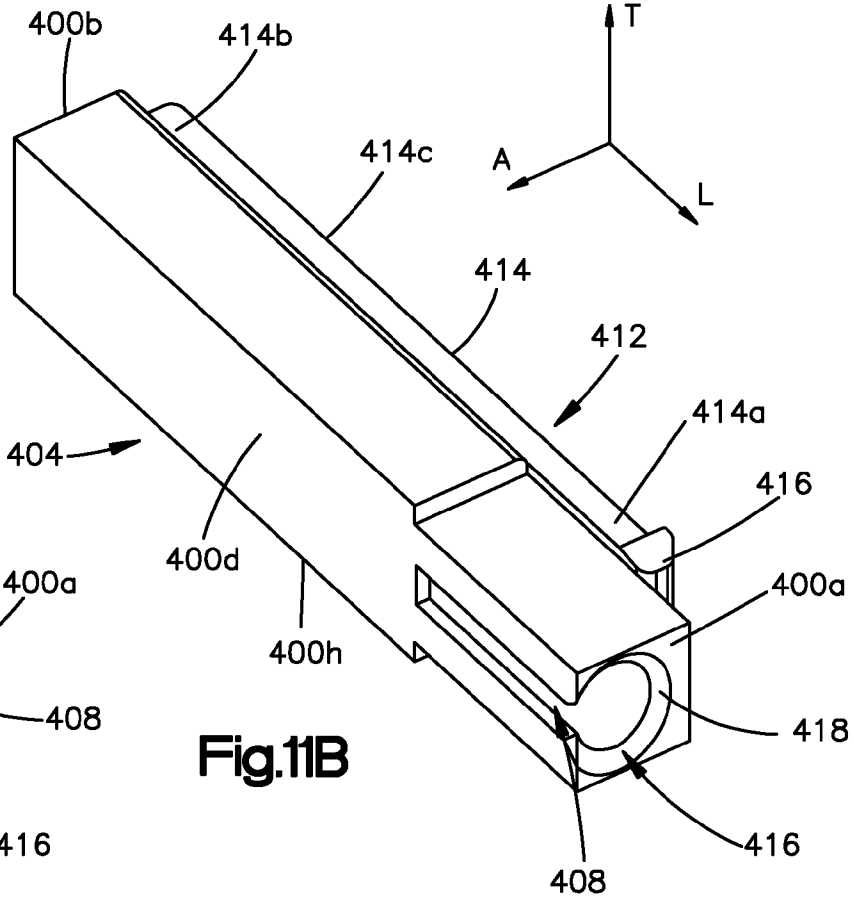
FIGS. 11A-B are perspective views of modular closure members constructed in accordance with still another alternative embodiment.
Figure 11A:
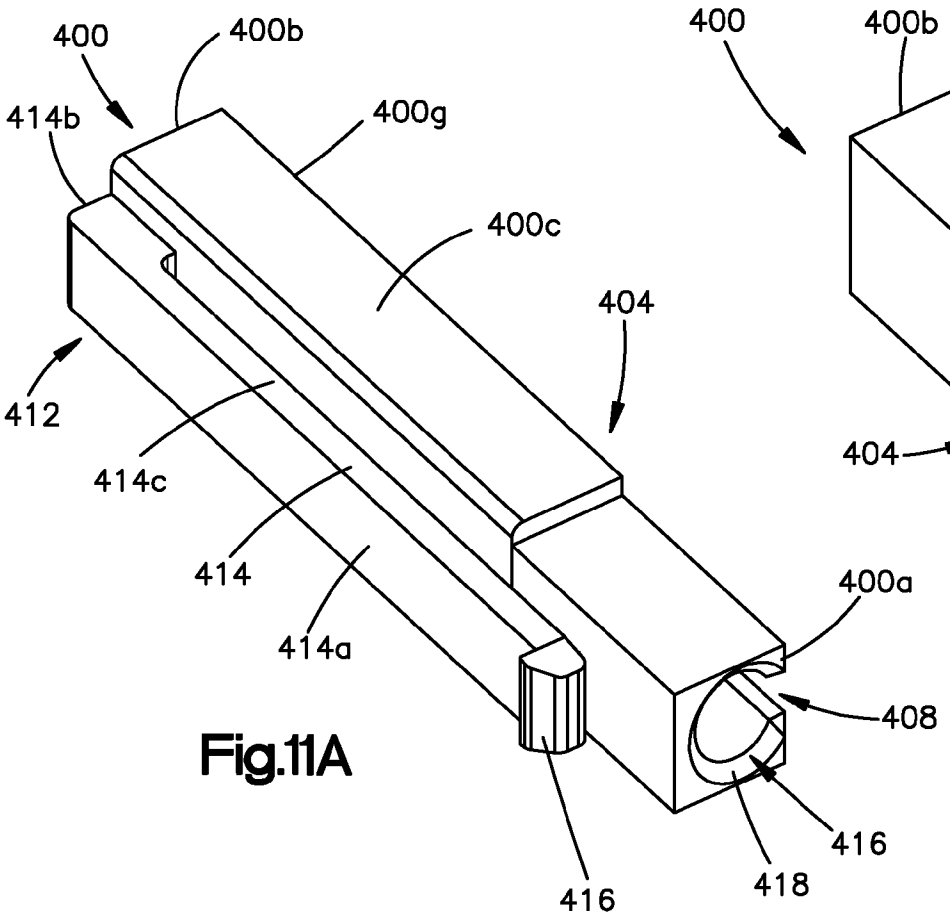

Referring now to FIGS. 10A-C, the first electrical connector 100 can be constructed in accordance with an alternative embodiment wherein the first and second end members 401*a* and 401*b* (see FIG. 6) are replaced with first and second end members 403*a* and 403*b*. The illustrated embodiment of the first electrical connector 100 can be assembled as described elsewhere herein, for instance with reference to the first electrical connector 100 illustrated in FIG. 6. The first electrical connector 100 illustrated in FIG. 10A can be mated to the second electrical connector 800 illustrated in FIGS. 10A-B by inserting the first electrical connector 100 into the second electrical connector 800 along the mating direction M, such that the complementary pluralities of electrical power contacts and electrical signal contacts of the first and second electrical connectors 100 and 800 engage with one another, thereby placing the first electrical connector 100 into electrical communication with the printed circuit board 702 via the second electrical connector 800.

As the first electrical connector 100 is mated to the second electrical connector 800, the hooks 415 of the respective latch arms 414 of the first and second end member 403*a* and 403*b* will come into contact with respective ones of first and second end members 400*a*' and 400*b*', causing the latch arms 414 to be biased inward along the lateral direction A. As the first electrical connector 100 advances further forward along the mating direction M, the hooks 415 will be disposed into respective ones of the latch openings 402' of the first and second end members 400*a*' and 400*b*'. The latch arms 414 will then resiliently snap back into their original non-biased orientations, thereby releasably locking the first electrical connector 100 to the second electrical connector 800.

Referring now to FIGS. 11A-B and 12A-C, the end member 400 can include at least one guidance member 416 configured to cooperate with a complementary guidance member 404' supported by the end member 400'. For example, the end member 404 can be constructed substantially the same as the end member 403, with the addition of at least one guidance member 416. In accordance with the illustrated embodiment, the end member 404 can include a guidance member 416 in the form of a bore 418 that extends into the front end 400*a* along the longitudinal direction. The bore 418 can be at least partially open to the recess 408. The bore 418 can be sized to receive and engage with a complementary guidance member 404' supported by the end member 400'. For example, the end member 400' can include a complementary guidance member 404' in the form of a post 406' that extends outward from a front end of the end member 400', the post 406' configured to be received in the bore 418 when the first electrical connector 100 is mated to the second electrical connector 800. The bore 418 and the post 406' can cooperate to ensure proper alignment of the respective pluralities of electrical power contacts and electrical signal contacts of the first and second connector housings 200 and 300 of the first electrical connector 100 and the first and second connector housings 200' and 300' of the second electrical connector 800 during mating of the first electrical connector 100 to the first electrical connector 100.

It should be appreciated that the end member 404 and the end member 400' are not limited to the illustrated guidance members, and that the end member 404, and that end member 400' can be alternatively configured using any other suitable guidance members as desired. For example, referring now to FIG. 13, each of the first and second end members 404*a* and 404*b* can include a guidance member 416 in the form of a post 420 that extends outward from the front end 400*a* of the end member 404, the post 420 configured to be received by a complementary guidance member 404' supported by the end member 400'. For example, each of the first and second end members 400*a*' and 400*b*' can include a complementary guidance member 404' in the form of a bore 408' that extends into the front end of the end member 400' along the longitudinal direction L. The post 420 and the bore 408' can be configured to cooperate substantially the same as the post 406' and the bore 418 when the first electrical connector 100 is mated to the second electrical connector 800. As shown in FIG. 13, the second connector housing 300 can include a plurality of holes that are defined by the second connector housing 300 and are positioned over the electrical signal contacts 304. One first plurality of holes, positioned over mating ends of the electrical signal contacts, can be heat holes. A second plurality of holes, positioned over between the first plurality of holes and a cable insertion end of the second connector housing, can be electrical signal contact 304 retention holes.

Figure 12A:
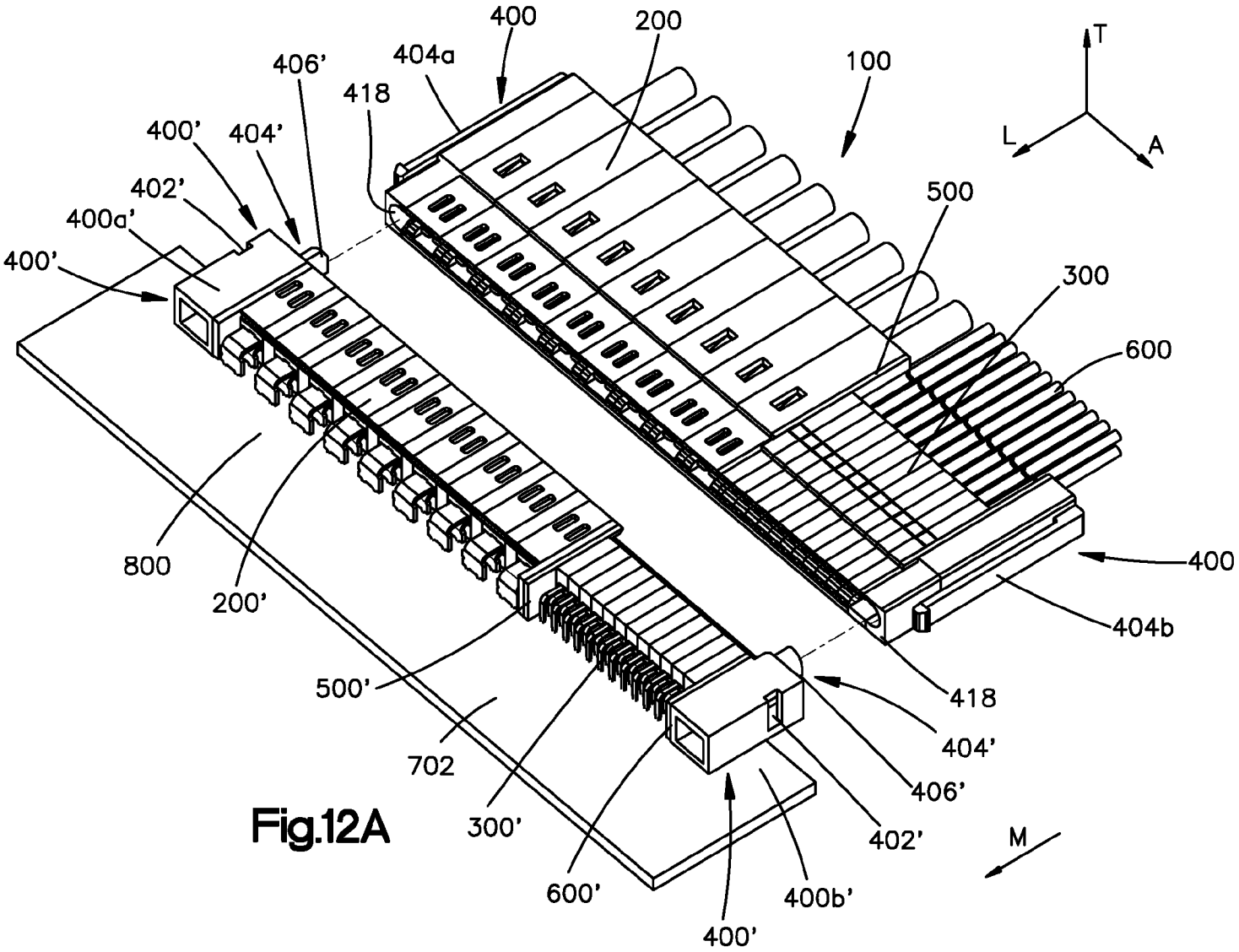
FIG. 12A is a perspective view of a first electrical assembly constructed in accordance with an alternative embodiment utilizing the closure members illustrated in FIGS. 11A-B and a second electrical assembly configured as a header connector mounted to a substrate.
Figure 12B:
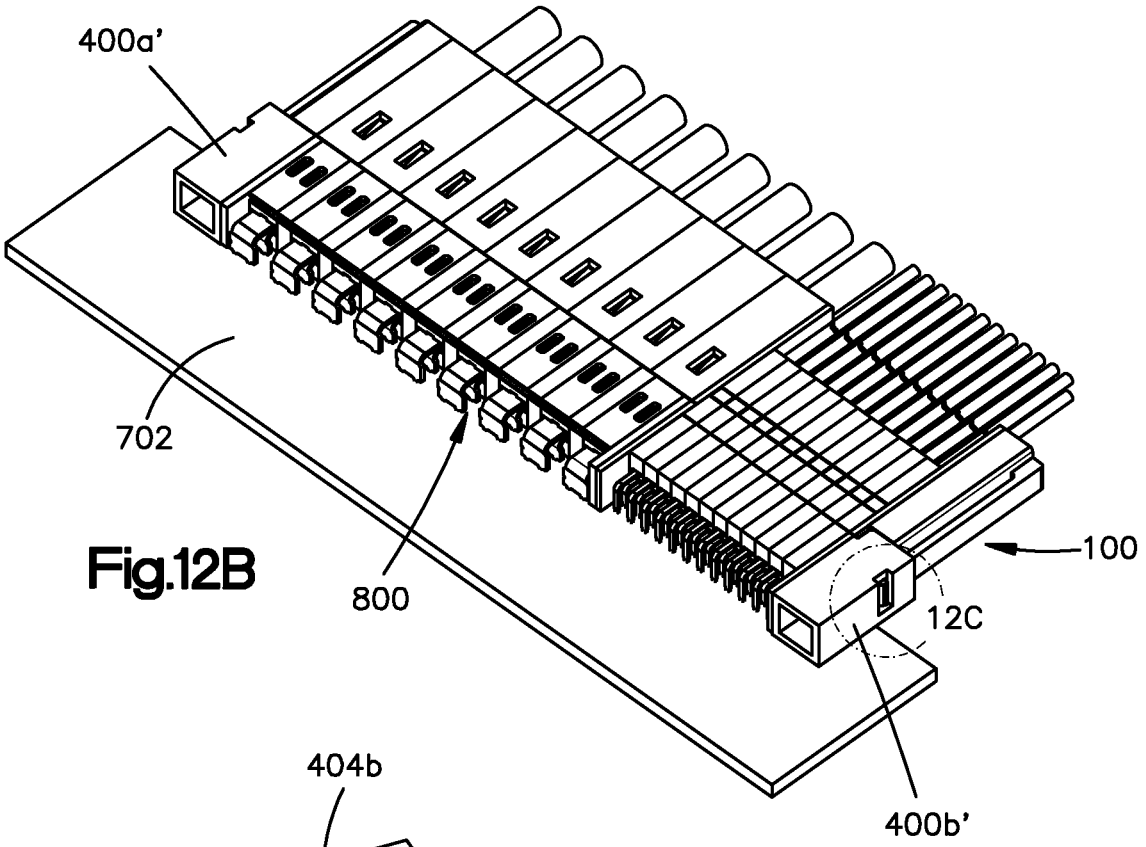
FIGS. 12B-C are perspective views of the first and second electrical assemblies illustrated in FIG. 12A mated to one another.
Figure 12C:
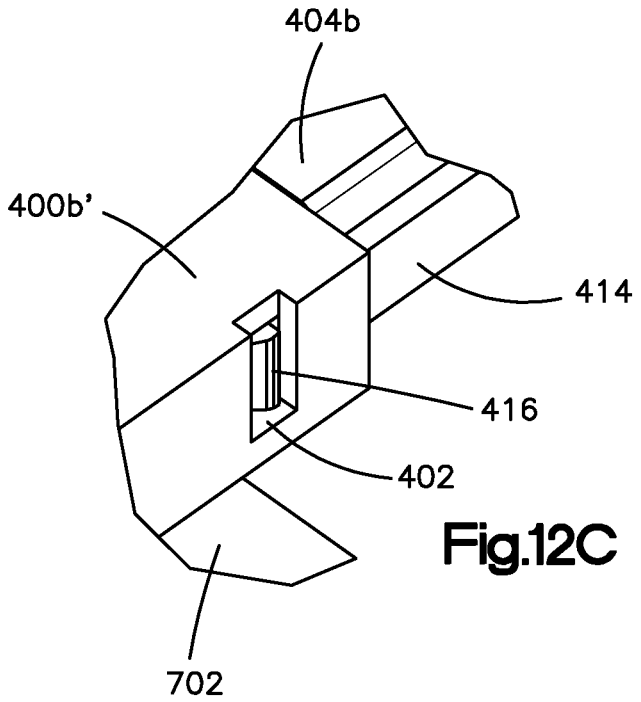

Referring now to FIGS. 12A-C, the first electrical connector 100 can be constructed in accordance with an another alternative embodiment wherein the first and second end members 401*a* and 401*b* (see FIG. 6) are replaced with first and second end members 404*a* and 404*b*. The illustrated embodiment of the first electrical connector 100 can be assembled as described elsewhere herein, for instance with reference to the first electrical connector 100 illustrated in FIG. 6. The first electrical connector 100 illustrated in FIG. 10A can be mated to the second electrical connector 800 illustrated in FIGS. 12A-B by inserting the first electrical connector 100 into the second electrical connector 800 along the mating direction M, such that the complementary pluralities of electrical power contacts and electrical signal contacts of the first and second electrical connectors 800 engage with one another, thereby placing the first electrical connector 100 into electrical communication with the printed circuit board 702 via the second electrical connector 800.

As the first electrical connector 100 is mated to the second electrical connector 800, the posts 406' of the first and second end members 400*a*' and 400*b*' will be received in respective the bores 418 of the first and second end members 404*a* and 404*b*, thereby causing the complementary pluralities of electrical power contacts and electrical signal contacts of the first and second electrical connectors 800 to align with one another. As the first electrical connector 100 is inserted further into the second electrical connector 800, the hooks 415 of the respective latch arms 414 of the first and second end member 404*a* and 404*b* will come into contact with respective ones of first and second end members 400*a*' and 400*b*', causing the latch arms 414 to be biased inward along the lateral direction A. As the first electrical connector 100 advances further forward along the mating direction M, the hooks 415 will be disposed into respective ones of the latch openings 402' of the first and second end members 400*a*' and 400*b*'. The latch arms 414 will then resiliently snap back into their original non-biased orientations, thereby releasably locking the first electrical connector 100 to the second electrical connector 800.

Referring now to FIGS. 14A-D, the first electrical connector 100 can be constructed with first connector housings 200 supporting a plurality of second power contact inserts 212*b* comprising twelve second power contact insert 212*b*, such that the first electrical connector 100 will include a plurality of power cables 250 comprising twelve power cables 250. Of course the printed circuit board 702 can be constructed with a corresponding number of electrical power contact pads 708 and electrical signal contact pads 710, as illustrated in FIG. 4B.

It should be appreciated that the first electrical connector 100 is not limited to the embodiments illustrated herein, and that the first electrical connector 100 can be constructed utilizing a different arrangement of the components of the illustrated embodiment, or different components, in any combination as desired. For example, the first electrical connector 100 can be alternatively constructed in accordance with any of the following embodiments. The first electrical connector 100 can be constructed utilizing one or both of two or more first connector housings 200 and two or more second connector housings 300. For instance, the electrical assembly can be constructed such that the position of the first connector housing 200 and the second connector housing 300 along the lateral direction A are reversed. In accordance with another alternative embodiment, the first electrical connector 100 can be constructed having a second connector housing 300 and a pair of first connector housings 200, each first connector housing 200 disposed adjacent to a respective one of the first and second sides 300*c* and 300*d* of the second connector housing 300. Alternatively, the electrical assembly can be constructed using only a first connector housing 200, or only a second connector housing 300. It should further still be appreciated that the second electrical connector 800 can be alternatively constructed to mate with any of the above-described embodiments of the first electrical connector 100.

The components of at least one or both of the first electrical connector 100 and the second electrical connector 800 can be provided as a kit. The kit can include any combination of the components of one or both of the first electrical connector 100 or the second electrical connector 800 as desired. For instance, the kit can include any combination of first connector housings 200, first connector housing 300, first connector housings 200', and first connector housings 300'. The kit can further include any number of the first and second power contact inserts 212*a* and 212*b* and signal contact inserts 312, in any combination. The first and second connector housings 200, 300, 200', 300' can be configured the same or differently. The kit can further include any number of end member 400, such as the end members 401, 402, 403, or 404, and the end members 400' in any combination, as desired. The kit can further include any number of one or all of the interconnect members 500 and 500' and the spacer members 600 and 600', in any combination.

In accordance with an embodiment, a method of assembling one or both of the first and second electrical connectors 800 can comprise the steps of providing or teaching the use of at least one of a first connector housing 200 and a second connector housing 300, first and second end members 400 or 400', such as first and second end members 401*a* and 401*b*, first and second end member 402*a* and 402*b*, first and second end member 403*a* and 403*b*, first and second end member 404*a* and 404*b*, or first and second end member 400*a*' and 400*b*'. The method can further include teaching the step of mounting the first end member 400 to a respective side of one of the first and second connector housings 200 and 300, such as the first and second sides 200*c* and 200*d* of the first connector housing 200 or the first and second sides 300*c* and 300*d* of the second connector housing 300. The method can further include teaching the step of mounting the second end member 400 to a respective side of one of the first and second connector housings 200 and 300, such as the first and second sides 200*c* and 200*d* of the first connector housing 200 or the first and second sides 300*c* and 300*d* of the second connector housing 300.

Although the electrical assembly has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described electrical assembly. Those skilled in the relevant art, having the benefit of the teachings of this specification, may effect numerous modifications to the electrical assembly as described herein, and changes may be made without departing from the scope and spirit of the instant disclosure, for instance as recited in the appended claims.

What is claimed:

1. An electrical connector comprising:

a first connector housing and a plurality of electrical power contacts supported by the first connector housing, the first connector housing having a first housing body that defines a front end, a rear end spaced from the front end along a mating direction, and opposed first and second sides that extend between the front and rear ends and spaced apart from each other along a second direction that extends substantially perpendicular to the mating direction, the first housing body further defining a receptacle at the front end that is elongate along the second direction so as to define a power mating interface, wherein the receptacle extends through the first and second sides; and a second connector housing and a plurality of electrical signal contacts supported by the second connector housing, the second connector housing having a second housing body that defines a front end, a rear end spaced from the front end along the mating direction, and opposed first and second sides extending between the front and rear ends of the second connector housing and spaced apart from each other along the second direction, the first side of the second connector disposed adjacent the second side of the first connector housing, the second housing body further defining a receptacle at the front end that extends along the second direction so as to define a signal mating interface, wherein the receptacle of the second connector housing extends through the first and second sides of the second connector housing;

a first end member that is separate from the first connector housing and is configured to be coupled to the first side of the first connector housing so as to close one end of the receptacle of the first connector housing; and a second end member that is separate from the second connector housing and is configured to be coupled to the second side of the second connector housing so as to close one end of the receptacle of the second connector housing.

2. The electrical connector of claim 1, further comprising an interconnecting member configured to be disposed between the first and second connector housings, such that the interconnecting member is coupled to the second side of the first connector housing and further coupled to the first side of the second connector housing.

3. The electrical connector of claim 1, further comprising a spacer member configured to be disposed between one of the first and second connector housings and the respective one of the first and second end members, such that the one of the first and second end members is affixed to the spacer member.

4. The electrical connector of claim 3, wherein the spacer member is affixed to the second end of the second connector housing, and the second end member is affixed to the spacer member.

5. The electrical connector of claim 1, wherein the at least one of the first and second end members comprises a latch member that is configured to secure the one of the first and second end members to a complementary electrical device that is mated to the electrical connector.

6. The electrical connector of claim 5, wherein the at least one of the first and second end members further comprises a guidance member that is configured to guide the complementary electrical device to mate with the electrical connector.

7. The electrical connector of claim 6, wherein the guidance member is disposed adjacent the latch member.

8. The electrical connector of claim 6, wherein the guidance member comprises a bore that extends into the at least one of the first and second end members along the mating direction.

9. The electrical connector of claim 6, wherein the guidance member comprises a post that extends forward from the at least one of the first and second end members along the mating direction.

10. A method comprising:

coupling a first end member to a first side of a first connector housing wherein the first end member is separate from the first connector housing before coupling the first end member to the first side, the first connector housing supporting a plurality of electrical power contacts and defining a receptacle that is elongate along a mating end of the first connector housing from the first side to an opposed second side that is spaced from the first side, wherein the receptacle defines a mating interface and extends through the first and second sides; and coupling a second end member to a second side of a second connector housing wherein the second end member is separate from the second connector housing before coupling the second end member to the second side, the second connector housing supporting a plurality of electrical signal contacts and defining a receptacle that is elongate along a mating end of the second connector housing from the first side of the second connector housing to an opposed second side of the second connector housing that is spaced from the first side of the second connector housing, wherein the receptacle defines a mating interface and extends through the first and second sides; and closing the receptacle at the first side of the first connector housing by coupling the first end member to the first side of the first connector housing.

11. The method of claim 10, further comprising the step of closing the receptacle at the second side of the second connector housing by coupling the second end member to the second side of the second connector housing.

12. The method of claim 10, further comprising the step of coupling an interconnect member to the second side of the first connector housing and the first end of the second connector housing so as to couple the first and second connector housings to each another.

13. The method of claim 12, further comprising affixing a spacer member between the second connector housing and the second end member.

14. The method of claim 12, further comprising the step of mounting the first and second connector housings onto a substrate.

15. The method of claim 14, further comprising the step of inserting the interconnect member into a complementary recess in the substrate during the mounting step.

16. A kit comprising:

at least one first connector housing supporting a plurality of electrical power contacts, the first connector housing having a first housing body that defines a front end, a rear end spaced from the front end along an mating direction, and opposed first and second sides that extend between the front and rear ends and are spaced apart from each other along a second direction that extends substantially perpendicular to the mating direction, the first housing body further defining a receptacle at the front end that is elongate along the second direction so as to define a power mating interface, wherein the receptacle extends through the first and second sides;

at least one second connector housing supporting a plurality of electrical signal contacts, the second connector housing having a second housing body that defines a front end, a rear end spaced from the front end along the mating direction, and opposed first and second sides that extend between the front and rear ends of the second connector housing and are spaced apart from each other along the second direction, the second housing body further defining a receptacle at the front end that extends along the second direction so as to define a signal mating interface, wherein the receptacle extends through the first and second sides of the second connector housing; and a plurality of closure members configured to be coupled to at least one of the first and second sides of at least one of the first and second connector housings so as to close at least one end of the corresponding receptacle, wherein the plurality of closure members are separate from the at least one first and second connector housings before being coupled to the at least one first and second connector housings.

17. The kit of claim 16, wherein at least one of the closure members comprises an interconnect member configured to be coupled between the first and second connector housings.

18. The kit of claim 17, wherein the second end of the first connector housing is disposed adjacent to the first end of the second connector housing, the first end of the first connector housing is a free end, and the second end of the second connector housing is a free end, and at least one of the closure members comprises an end member configured to be affixed to at least one of the free ends of the first and second connector so as to close a corresponding at least one end of the respective receptacle.

19. The kit of claim 18, further comprising a plurality of spacer member configured to be affixed between respective sides of the at least one of the first and second connector housings and the end member.

20. The kit of claim 18, wherein at the end member comprises a latch member configured to secure the at least one of the plurality of end members to a complementary electrical device that is mated to the first and second connector housings.

21. The kit of claim 18, wherein the end member further comprises a guidance member that is configured to guide the complementary electrical device to mate with the first and second connector housings.

22. A method of assembling an electrical assembly, the method comprising the steps of:

providing or teaching the use of a first connector housing supporting a plurality of electrical power contacts and defining a first receptacle that extends along a front end of the first connector housing and through opposed first and second sides of the first connector housing, a second connector housing supporting a plurality of electrical signal contacts and defining a second receptacle that extends along a front end of the second connector housing and through opposed first and second sides of the second connector housing, and first and second end members configured to close respective ones of the first and second receptacles;

teaching the step of mounting the first end member to the first side of the first connector housing; and teaching the step of mounting the second end member to the second side of the second connector housing, wherein the first and second end members are separate from the first and second connector housings before being mounted onto the first and second sides.

23. The method of claim 22, further comprising the steps of:

providing or teaching the use of at least one interconnect member configured to be affixed to the second side of the first connector housing and the first side of the second connector housing; and teaching the step of mounting the interconnect member to the second side of the first connector housing and the first side of the second connector housing so as to couple the first connector housing to the second connector housing.

24. The electrical connector of claim 1, wherein each of the first and second end members defines opposed inner and outer sides that are separate from the first and second sides of each of the first and second connector housings.

25. The electrical connector of claim 1, wherein the first and second end members are configured to be releasably attached to the first side of the first connector housing and second side of the second connector housing, respectively.

26. The method of claim 10, wherein each of the first and second end members defines opposed inner and outer sides that are separate from the first and second sides of each of the first and second connector housings.

27. The method of claim 10, wherein:

coupling the first end member comprises releasably attaching the first end member to the first side of the first connector housing; and coupling the second end member comprises releasably attaching the second end member to the second side of the second connector housing.

28. The kit of claim 16, wherein each of the closure members defines opposed inner and outer sides that are separate from the first and second sides of each of the first and second connector housings.

29. The kit of claim 16, wherein each of the closure members is configured to be releasably attached to at least one of the first side of the first connector housing and second side of the second connector housing.

30. The method of claim 22, wherein each of the first and second end members defines opposed inner and outer sides that are separate from the first and second sides of each of the first and second connector housings.

31. The method of claim 22, wherein:

teaching the step of mounting the first end member includes teaching the step of releasably attaching the first end member to the first side of the first connector housing; and teaching the step of mounting the second end member includes teaching the step of releasably attaching the second end member to the second side of the second connector housing.

* * * * *